US009335727B2

(12) United States Patent
Abe

(10) Patent No.: US 9,335,727 B2
(45) Date of Patent: May 10, 2016

(54) DRUM CARTRIDGE INCLUDING A COUPLING ACCOMMODATING ROLLER MOVEMENT

(71) Applicant: BROTHER KOGYO KABUSHIKI KAISHA, Nagoya-shi, Aichi-ken (JP)

(72) Inventor: Koji Abe, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/664,215

(22) Filed: Mar. 20, 2015

(65) Prior Publication Data

US 2015/0277347 A1 Oct. 1, 2015

(30) Foreign Application Priority Data

Mar. 31, 2014 (JP) ..... 2014-071835

(51) Int. Cl.
*G03G 21/16* (2006.01)
*G03G 21/18* (2006.01)
*G03G 21/00* (2006.01)

(52) U.S. Cl.
CPC ..... *G03G 21/169* (2013.01); *G03G 21/1857* (2013.01); *G03G 21/0058* (2013.01)

(58) Field of Classification Search
CPC ..... G03G 2221/0005; G03G 2221/001; G03G 21/0076; G03G 21/1814; G03G 21/1671; G03G 21/169; G03G 21/1857; G03G 21/0058
USPC ..... 399/111, 343, 353
See application file for complete search history.

(56) References Cited

U.S. PATENT DOCUMENTS

2003/0185588 A1* 10/2003 Takami ..... G03G 21/1814 399/111
2004/0037590 A1 2/2004 Morioka et al.
2005/0201772 A1* 9/2005 Ishii ..... G03G 21/1814 399/90
2006/0110184 A1* 5/2006 Yoshino ..... G03G 21/1857 399/167
2008/0175617 A1* 7/2008 Morishita ..... G03G 21/0035 399/99
2011/0318051 A1* 12/2011 Kamimura ..... G03G 15/757 399/111
2013/0084103 A1 4/2013 Hashimoto et al.
2013/0209137 A1* 8/2013 Hayashi ..... G03G 21/1623 399/111

FOREIGN PATENT DOCUMENTS

JP 2003307993 A 10/2003
JP 2008032955 A 2/2008
JP 2011095711 A 5/2011
JP 2013076827 A 4/2013

* cited by examiner

*Primary Examiner* — Francis Gray
(74) *Attorney, Agent, or Firm* — Merchant & Gould P.C.

(57) ABSTRACT

A drum cartridge and a method are disclosed. An example of the drum cartridge includes a photosensitive drum, a first cleaning roller, and a second cleaning roller. The drum cartridge includes a first cleaning gear rotatable with the first cleaning roller, a second cleaning gear rotatable with the second cleaning roller and engaging with the first cleaning gear, a drum gear being rotatable with the photosensitive drum, a first idle gear engaging with the drum gear, a second idle gear engaging with the first idle gear, and a coupling joining the second cleaning gear and the second idle gear, the coupling being rotatable in unison with the second cleaning gear and the second idle gear.

20 Claims, 14 Drawing Sheets

DRUM CARTRIDGE INCLUDING A COUPLING ACCOMMODATING ROLLER MOVEMENT

CROSS-REFERENCE TO RELATED APPLICATION

This application claims priority from Japanese Patent Application No. 2014-071835, filed on Mar. 31, 2014, which is incorporated herein by reference in its entirety.

TECHNICAL FIELD

Aspects described herein relate to a photosensitive body cartridge for an electrophotographic image forming apparatus.

BACKGROUND

A known image forming apparatus includes a printer that includes a photosensitive drum and a scraper roller for scraping and collecting foreign matter adhering to a surface of a photosensitive drum.

In such a printer, a drum gear is attached to an end portion of a shaft of the photosensitive drum, and a scraper-roller gear is attached to a rotating shaft of the scraper roller. A driving force is transmitted from the drum gear to the scraper-roller gear via a plurality of idle gears. A peripheral speed of the scraper roller relative to the photosensitive drum is increased to collect or remove foreign matter from the surface of the photosensitive drum effectively.

SUMMARY

In a first example aspect, a drum cartridge includes a photosensitive drum rotatable about an axis, a first cleaning roller including a first shaft extending in a direction extending along the axis, and a second cleaning roller including a second shaft extending in the direction, the second cleaning roller including a surface contacting a surface of the first cleaning roller, the second cleaning roller spaced apart from the photosensitive drum. The drum cartridge further includes a bearing through which the first shaft and the second shaft are inserted, a first cleaning gear rotatable with the first cleaning roller, and a second cleaning gear rotatable with the second cleaning roller and meshing with the first cleaning gear. The drum cartridge further includes a drum gear being rotatable with the photosensitive drum, a first idle gear meshing with the drum gear, and a second idle gear meshing with the first idle gear. The drum cartridge includes a coupling joining the second cleaning gear and the second idle gear, the coupling being rotatable in unison with the second cleaning gear and the second idle gear In a further example aspect, a method is disclosed that includes receiving, at a drum gear, a first rotational force applying a first rotational speed to a photosensitive drum, and transmitting a second rotational force to a first cleaning gear to rotate a first cleaning roller at a second rotational speed. Transmitting the second rotational force to the first cleaning roller includes rotating a first idle gear in response to rotation of the drum gear, the first idle gear engaged by the drum gear, rotating a second idle gear in response to rotation of the first idle gear, the second idle gear engaged by the first idle gear, rotating a second cleaning gear rotationally coupled to the second idle gear, and applying the second rotational force to the first cleaning gear from the second cleaning gear.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION

In general, the present disclosure relates to a photosensitive body cartridge useable in an electrophotographic image forming apparatus.

In a known printer, the scraper roller may be configured to come into contact with and move away from the photosensitive drum. The scraper roller may be urged toward the photosensitive drum by an urging spring. With this configuration, while the scraper roller is allowed to move slightly away from the photosensitive drum, the photosensitive drum and the scraper roller are in contact with each other at all times. Nevertheless, due to slight movement of the scraper roller away from the photosensitive drum, a state of engagement of teeth of any two gears disposed between the drum gear and the scraper roller gear in the gear train may be changed. This may cause variation in the peripheral speed of the scraper roller relative to the photosensitive drum, whereby foreign matter adhering to the surface of the photosensitive drum might not be removed therefrom evenly. However, some embodiments of the disclosure address such issues by providing a drum cartridge in which cleaning is performed on a surface of a photosensitive drum with stability and certainty. In the drum cartridge according to some aspects of the disclosure, cleaning may be performed on the surface of the photosensitive drum with stably and certainty. Such features can be accomplished, for example, via use of a coupling provided between gears provided in the drum cartridge that accommodates such movement of a roller.

1. Overview of Drum Cartridge

Figure 1:
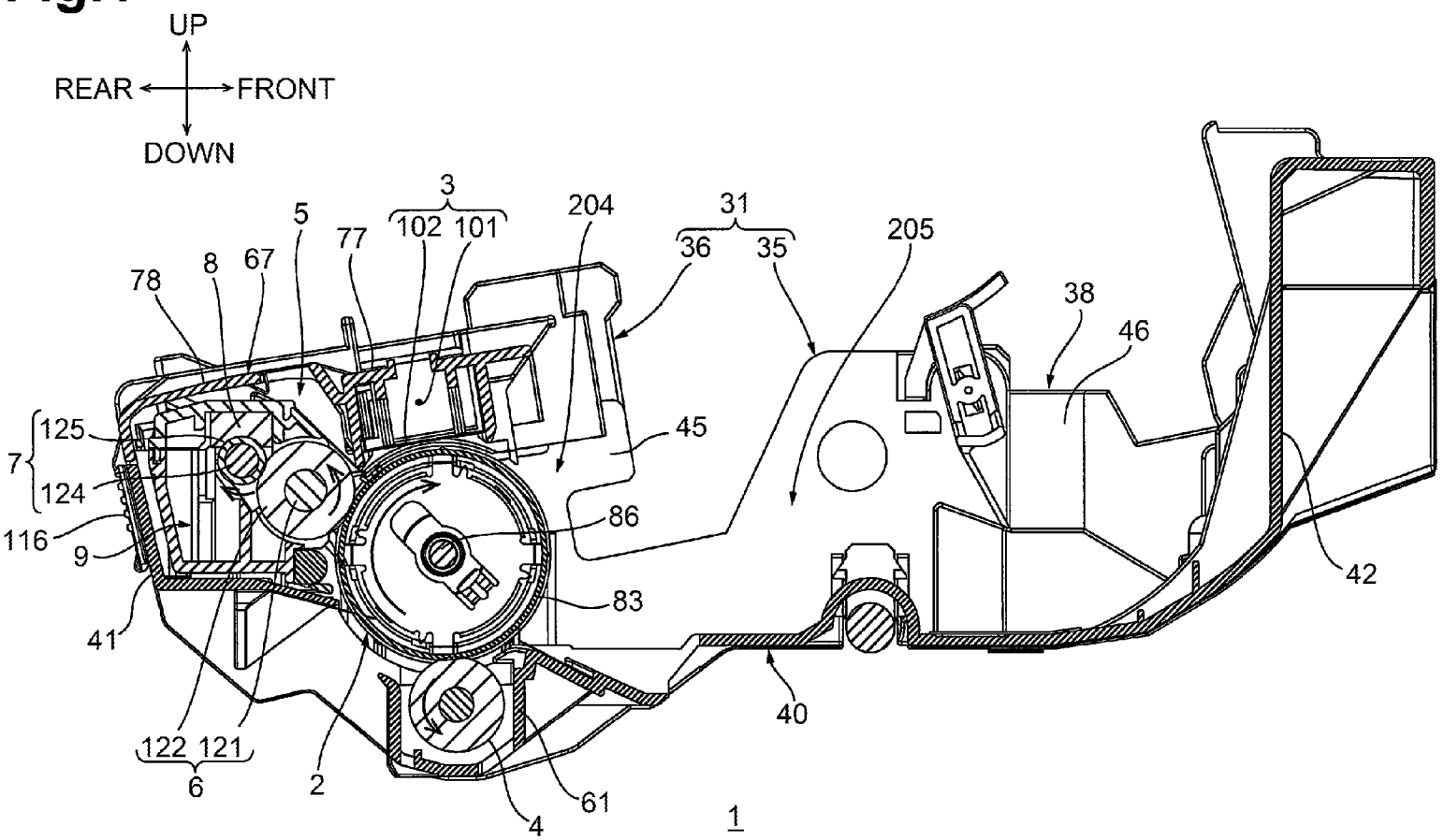
FIG. 1 is a central cross-sectional view depicting a drum cartridge in an illustrative embodiment according to one or more aspects of the disclosure.

As depicted in FIG. 1, a drum cartridge 1 has a generally rectangular frame shape having a bottom in plan view. The drum cartridge 1 is an example of a photosensitive body cartridge. The drum cartridge 1 includes a photosensitive drum 2, a scorotron charger 3, a transfer roller 4, and a cleaning unit 5.

In the description below, the side on which the photosensitive drum 2 is disposed in the drum cartridge 1 is defined as the rear of the drum cartridge 1 and the opposite side of the drum cartridge 1 is defined as the front of the drum cartridge 1. The right and left of the drum cartridge 1 are defined with reference to the front of the drum cartridge 1. More specifically, the orientation of the drum cartridge 1 is defined with reference to directional arrows appended in each drawing.

Figure 4B:
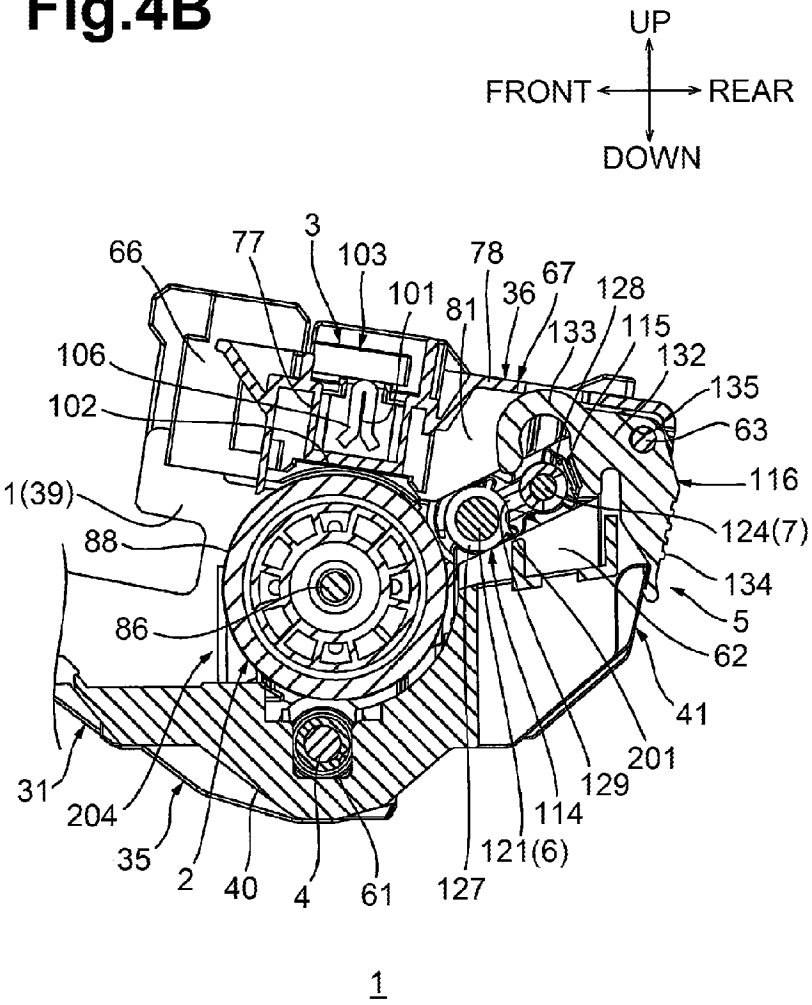
FIG. 4B is a side sectional view depicting of the rear portion of the drum cartridge depicted in FIG. 1 in the illustrative embodiment according to one or more aspects of the disclosure, wherein the pair of release levers is located at the first position.
Figure 13A:
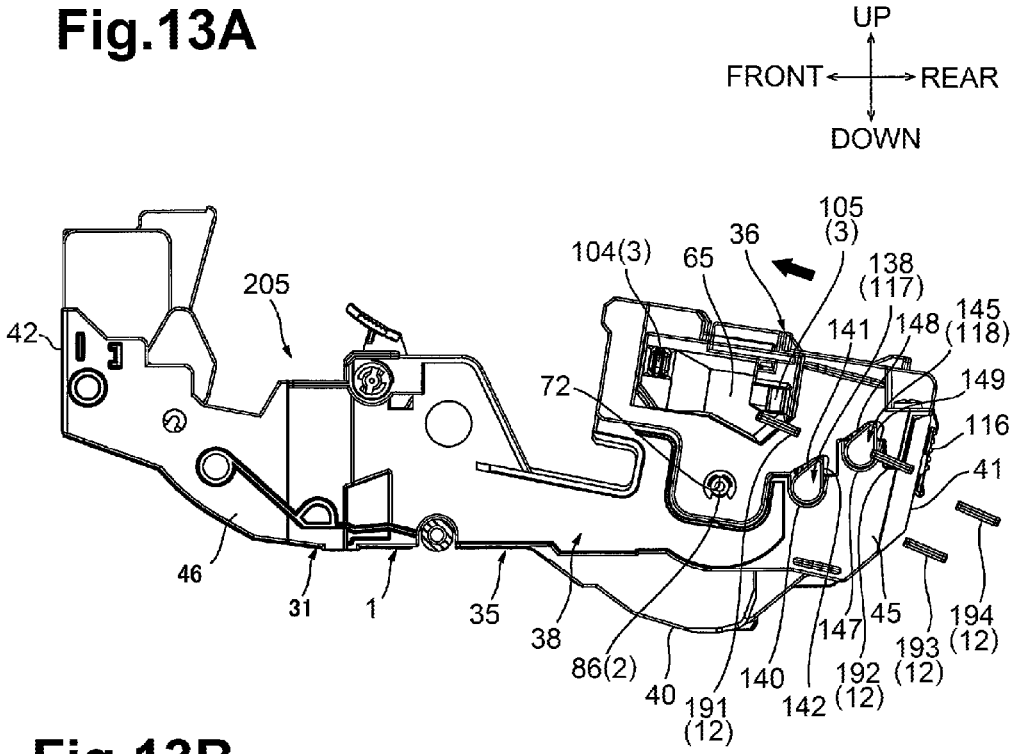
FIG. 13A illustrates an initial state of the drum cartridge depicted in FIG. 1 with respect to a main body of the image forming apparatus in a procedure to install the drum cartridge in the main body in the illustrative embodiment according to one or more aspects of the disclosure.

As depicted in FIG. 4B, a direction that a pair of roller shaft guides 201 extends, hereinafter, is referred to as "extending direction". As depicted in FIG. 13A, a direction that the drum cartridge 1 is attached to and detached from the main body 12, hereinafter, is referred to as "attaching and detaching direction".

The photosensitive drum 2 has a generally cylindrical shape extending in the right-left direction. The photosensitive drum 2 is supported at a rear end portion of the drum cartridge 1.

The scorotron charger 3 is disposed above the photosensitive drum 2 and is spaced apart from the photosensitive drum 2.

The transfer roller 4 is disposed below the photosensitive drum 2. The transfer roller 4 is in contact with a lower surface of photosensitive drum 2.

The cleaning unit 5 is disposed behind the photosensitive drum 2. The cleaning unit 5 includes a first roller 6, a second roller 7, a sponge scraper 8, and a storage 9. The first roller 6 is an example of a first cleaning roller. The second roller 7 is an example of a second cleaning roller.

The first roller 6 is disposed above and behind the photosensitive drum 2. The first roller 6 is in contact with an upper rear surface of the photosensitive drum 2.

The second roller 7 is disposed above and behind the first roller 6. The second roller 7 is in contact with an upper rear surface of the first roller 6.

The sponge scraper 8 is disposed above the second roller 7. The sponge scraper 8 is in contact with an upper surface of the second roller 7.

The storage 9 has a generally box shape with its upper front portion opened. The storage 9 is disposed below the second roller 7.

2. Usage of Drum Cartridge

Figure 2:
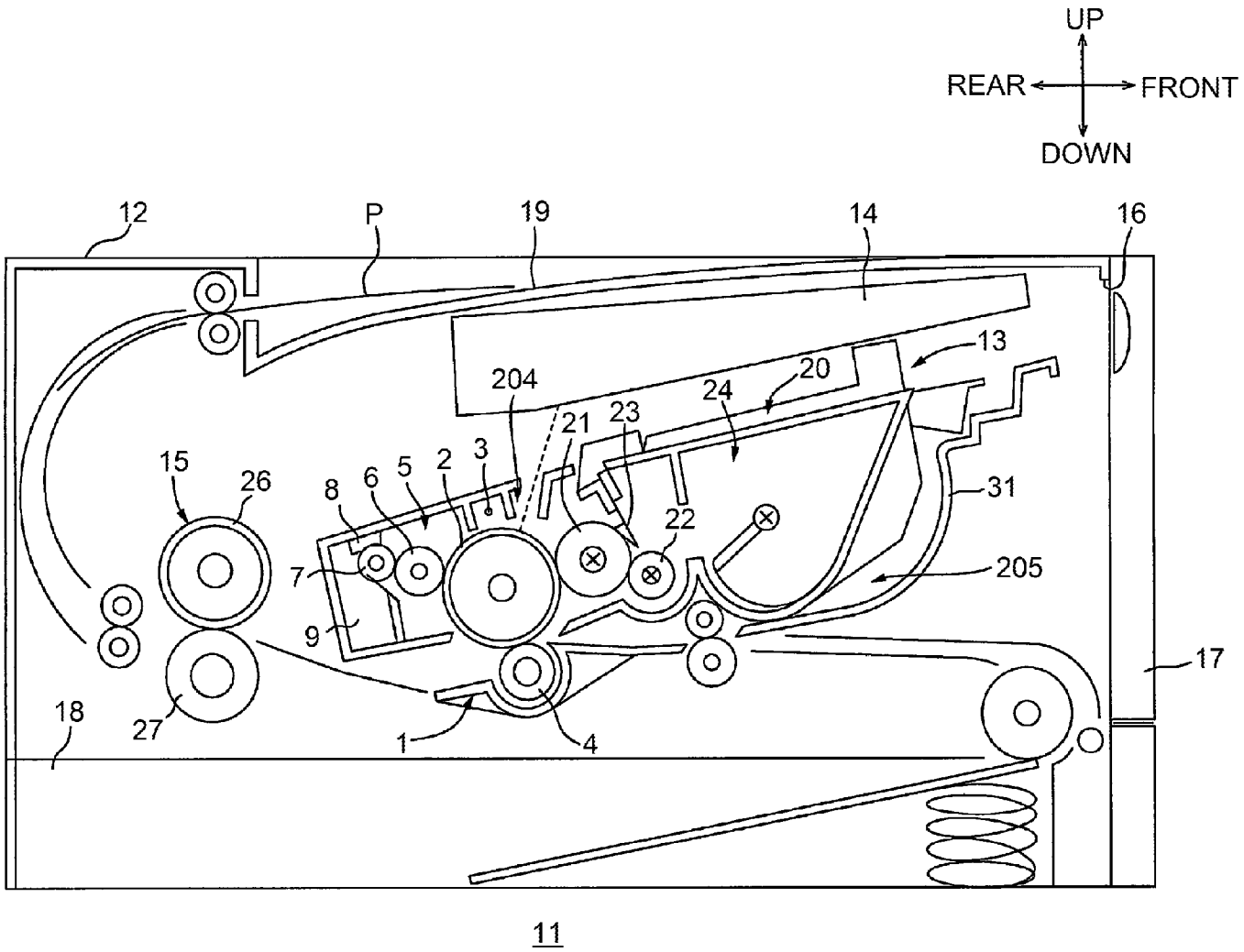
FIG. 2 is a central cross-sectional view depicting an image forming apparatus in which the drum cartridge depicted in FIG. 1 is installed in the illustrative embodiment according to one or more aspects of the disclosure.

As depicted in FIG. 2, the drum cartridge 1 is installed in an image forming apparatus 11 and used therein.

The image forming apparatus 11 may be an electrophotographic monochrome printer. The image forming apparatus 11 includes a main body 12, a process cartridge 13, a scanner unit 14, and a fixing unit 15. The main body 12 is an example of an apparatus body.

The main body 12 has a generally box shape. The main body 12 has an opening 16 defined therein and includes a front cover 17, a sheet feed tray 18, and a sheet discharge tray 19.

The opening 16 is defined in a front end portion of the main body 12. The opening 16 provides communication between the inside and the outside of the main body 12 in the front-rear direction to allow the process cartridge 13 to pass therethrough.

The front cover 17 is disposed at a front end of the main body 12. The front cover 17 has a generally flat plate shape. The front cover 17 extends in the upper-lower direction and is supported by a front wall of the main body 12 so as to be pivotable on its lower end portion. The front cover 17 is configured to expose or close the opening 16.

The sheet feed tray 18 is disposed at a bottom portion of the main body 12. The sheet supply tray 27 is configured to accommodate therein one or more sheets P.

The sheet discharge tray 19 is defined at a front half portion of an upper wall of the main body 12. The sheet discharge tray 19 is recessed relative to an upper surface of the main body 12 for supporting one or more sheets P thereon.

The process cartridge 13 is positioned at a substantially middle position of the main body 12 in the upper-lower direction. The process cartridge 13 is configured to be installed in and detached from the main body 12. The process cartridge 13 includes the drum cartridge 1 and a developing cartridge 20.

The developing cartridge 20 is attached to the drum cartridge 1 while being positioned in front of the photosensitive drum 2. The developing cartridge 20 includes a developing roller 21, a supply roller 22, a layer thickness regulating blade 23, and a toner container 24.

The developing roller 21 is rotatably supported at a rear end portion of the developing cartridge 20. The developing roller 21 has a generally cylindrical shape extending in the right-left direction. The developing roller 21 is in contact with a front surface of the photosensitive drum 2.

The supply roller 22 is disposed in front of and below the developing roller 2. The supply roller 22 has a generally cylindrical shape extending in the right-left direction and is rotatably supported by the developing cartridge 20. The supply roller 22 is in contact with an lower-front surface of the developing roller 21.

The layer thickness regulating blade 23 is disposed in front of and above the developing roller 21. The layer thickness regulating blade 23 is in contact with an front surface of the developing roller 21.

The toner container 24 is disposed in front of the supply roller 22 and the layer thickness regulating blade 23. The toner container 24 is configured to store toner therein.

The scanner unit 14 is disposed above the process cartridge 13. The scanner unit 14 is configured to emit a laser beam toward the photosensitive drum 2 based on image data.

The fixing unit 15 is disposed behind the process cartridge 13. The fixing unit 15 includes a heating roller 26 and a pressing roller 27. The pressing roller 27 is in pressure contact with a lower-rear surface of the heating roller 26.

As the image forming apparatus 11 starts an image forming operation, the scorotron charger 3 charges a surface of the photosensitive drum 2 uniformly and the scanner unit 14 exposes the surface of the photosensitive drum 4 with a laser beam. Thus, an electrostatic latent image based on image data is formed on the surface of the photosensitive drum 2.

The supply roller 22 supplies toner to the developing roller 21 from the toner container 24. Meanwhile, toner is positively charged between the developing roller 21 and the supply roller 22 and is then carried by the developing roller 21, and the layer-thickness regulating blade 23 regulates a layer thickness of toner carried by the developing roller 21.

The developing roller 21 then supplies the toner carried thereon to the surface of the photosensitive drum 2, i.e., the electrostatic latent image formed on the surface of the photosensitive drum 2. Thus, the photosensitive drum 2 carries a toner image on the surface thereof.

Rollers rotate to convey sheets P, one by one, to between the photosensitive drum 2 and the transfer roller 4 at a predetermined timing from the sheet feed tray 18. The transfer roller 4 transfers the toner image formed on the surface of the photosensitive drum 2 onto a sheet P while the sheet P passes between the photosensitive drum 2 and the transfer roller 4.

Then, the heating roller 26 and the pressing roller 27 apply heat and pressure, respectively, to the sheet P to thermally fix the toner image transferred onto the sheet P while the sheet P passes therebetween. After the toner image is fixed on the sheet P, the sheet P is discharged onto the sheet discharge tray 19.

The surfaces of the first and second rollers 6 and 7 are charged to positive potential that is higher than the potential of the surface of the photosensitive drum 2. More specifically, the surfaces of the first and second rollers 6 and 7 are charged such that the surface of the second roller 7 has positive potential higher than the positive potential of the first roller 6.

The first roller 6 removes paper dust from the surface of the photosensitive drum 2 when contacting the paper dust. That is, the first roller 6 cleans the surface of the photosensitive drum 2. The second roller 7 then removes the paper dust from the first roller 6 when contacting the paper dust.

Thereafter, the sponge scraper 8 scrapes and removes the paper dust from the second roller 7 and the collected paper dust is stored in the storage 9.

3. Details of Drum Cartridge

Figure 3:
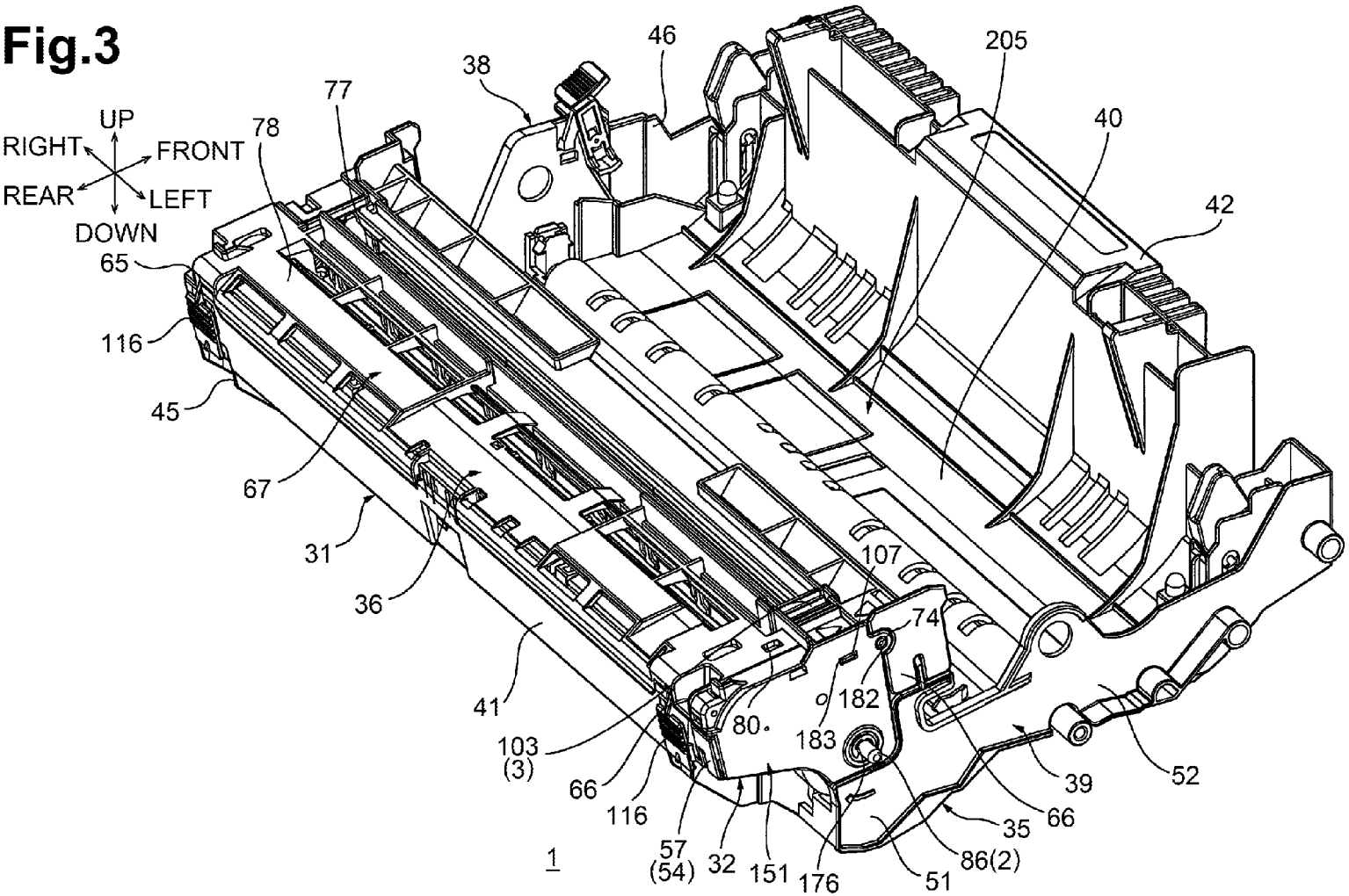
FIG. 3 is a perspective view depicting the drum cartridge depicted in FIG. 1 as viewed from the left rear in the illustrative embodiment according to one or more aspects of the disclosure.

As depicted in FIGS. 1 and 3, the drum cartridge 1 includes a drum frame 31, the photosensitive drum 2, the scorotron charger 3, the transfer roller 4, the cleaning unit 5, and a drive unit 32.

(1) Drum Frame

As depicted in FIG. 3, the drum frame 31 includes a base frame 35 and a cover frame 36.

The base frame 35 has a generally rectangular shape in plan view and has a bottom. The base frame 35 is made of resin material, for example, polystyrene ("PS"). The base frame 35 includes a right sidewall 38, a left sidewall 39, a bottom wall 40, a rear wall 41, and a front wall 42 that are integrated with each other.

The right sidewall 38 has a generally L-shaped plate shape in side view. The right sidewall 38 includes a rear portion 45 and a front portion 46.

Figure 4A:
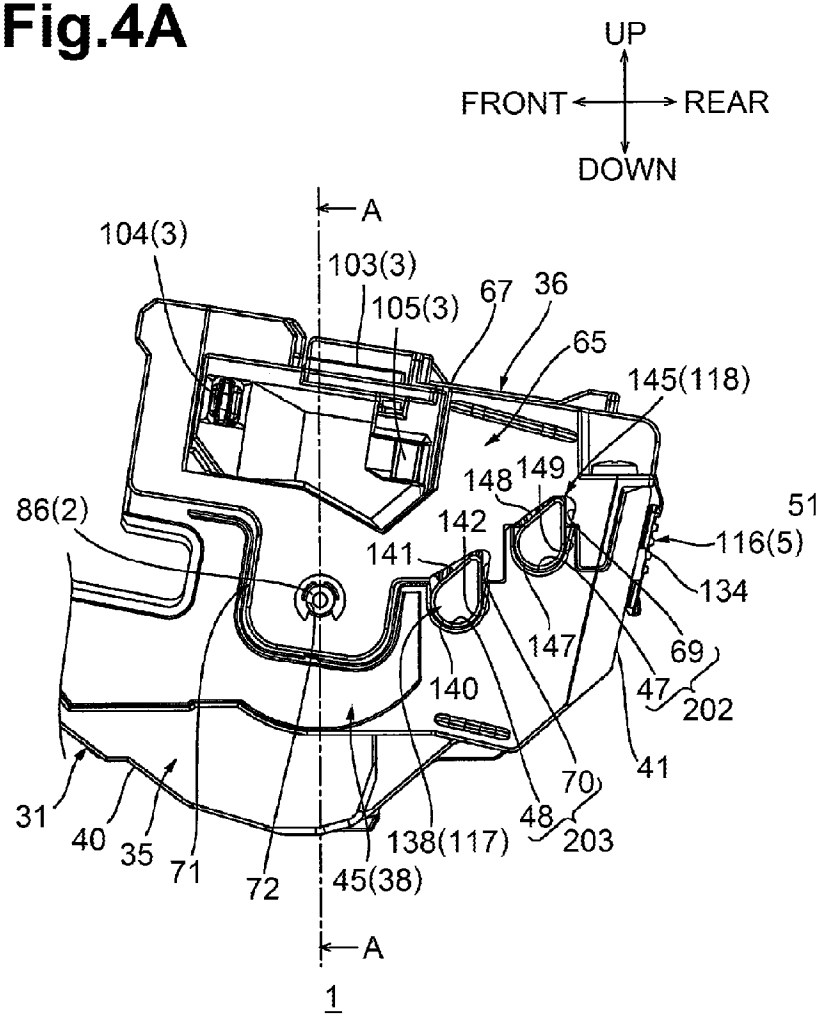
FIG. 4A is a right side view depicting a rear portion of the drum cartridge depicted in FIG. 1 in the illustrative embodiment according to one or more aspects of the disclosure, wherein a pair of release levers is located at a first position.
Figure 7A:
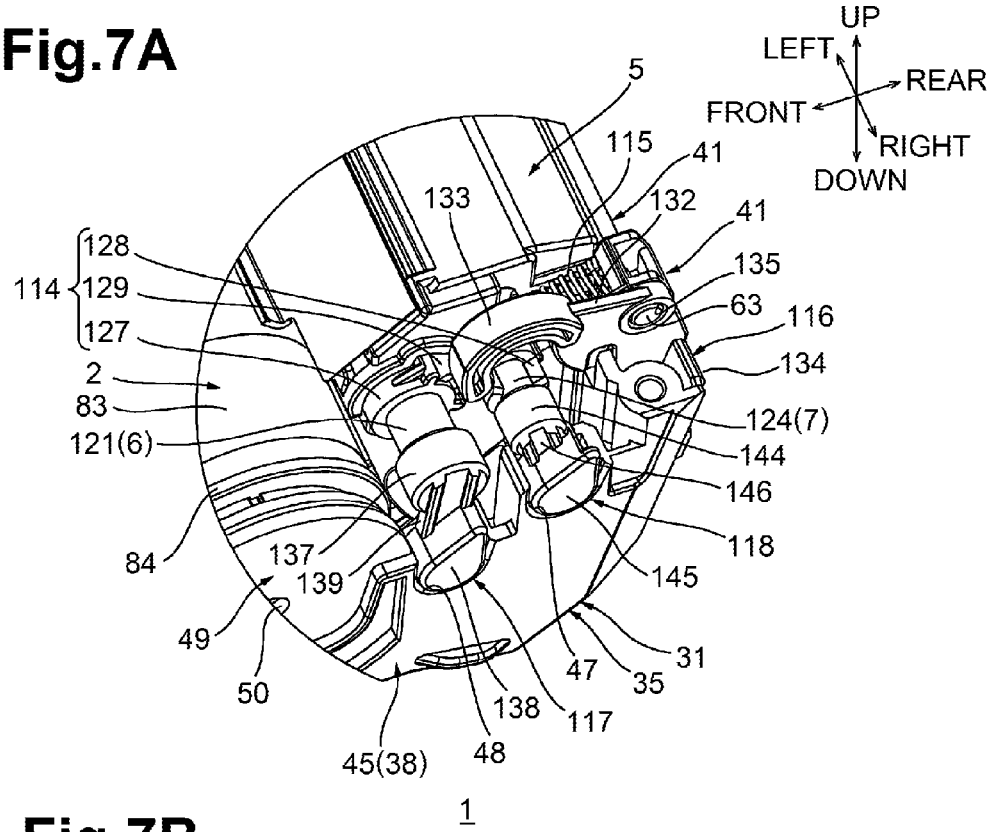
FIG. 7A is a partial perspective view depicting the drum cartridge depicted in FIG. 1 as viewed from the right front in the illustrative embodiment according to one or more aspects of the disclosure, wherein a cover frame is removed from the drum cartridge.

As depicted in FIG. 4A, the rear portion 45 constitutes a rear portion of the right sidewall 38. The rear portion 45 has a generally rectangular plate shape in side view. An upper surface of the rear portion 45 extends upward and rearward. As depicted in FIG. 7A, the rear portion 45 includes a first guide recess 47, a second guide recess 48, and a recess 49.

As depicted in FIGS. 4A and 7A, the first guide recess 47 is recessed downward relative to the upper surface of the rear portion 45 of the right wall 38 and has a generally U-shape.

The second guide recess 48 is recessed downward relative to the upper surface of the rear portion 45 of the right wall 38 and has a generally U-shape. The second guide recess 48 is disposed in front of the first guide recess 47.

The recess 49 is disposed at a front end portion of the rear portion 45. The recess 49 extends to a substantially middle portion of the rear portion 45 in the up-down direction and has a generally rectangular shape in side view. An upper portion of the recess 49 protrudes upward from the rear portion 45 of the right wall 38 and has a semicircular shape in side view. The recess 49 has a drum-shaft pass-through hole 50.

Figure 6:
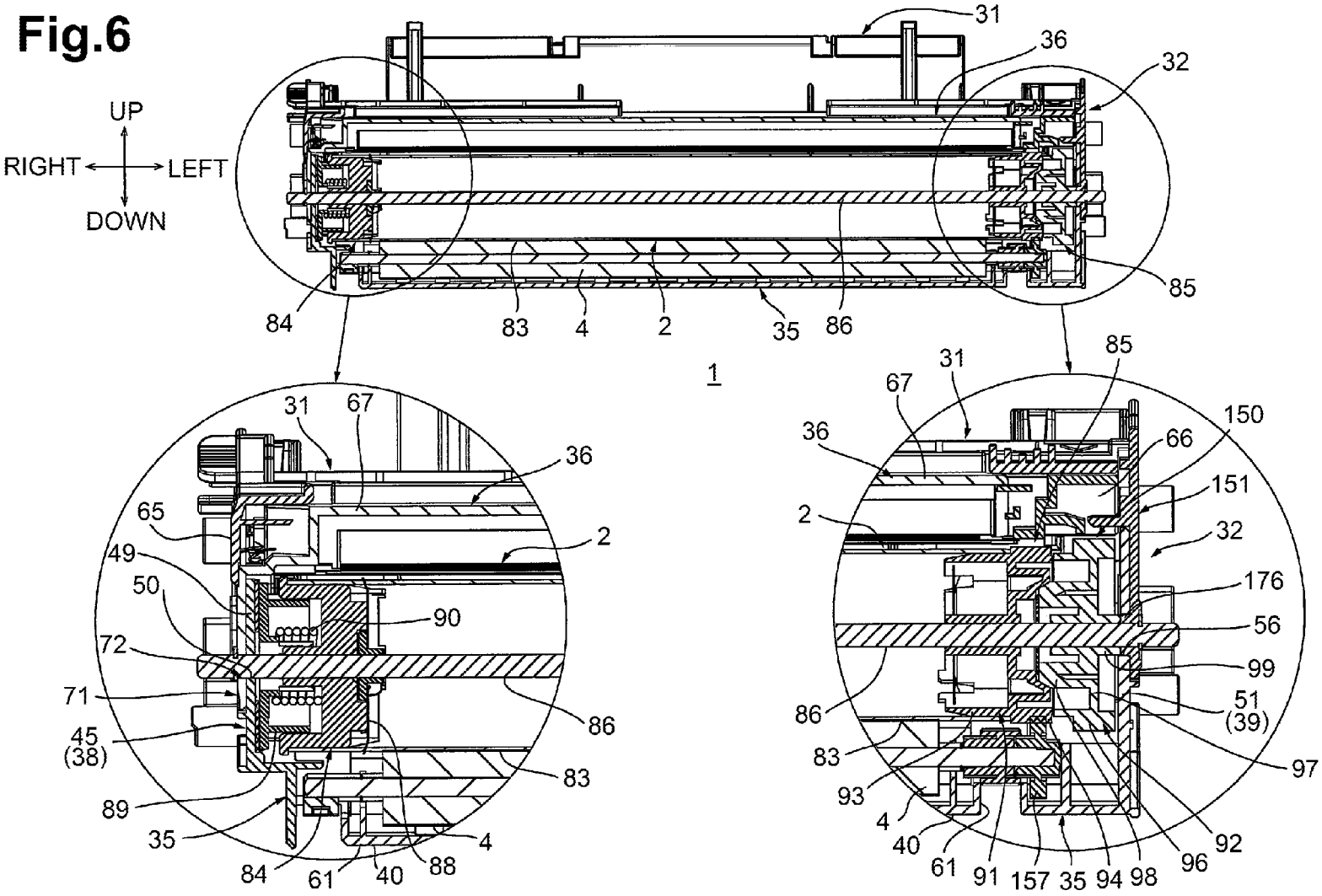
FIG. 6 is a cross-sectional view taken along line A-A in FIG. 4A in the illustrative embodiment according to one or more aspects of the disclosure.

As depicted in FIGS. 6 and 7A, the drum-shaft pass-through hole 50 penetrates through a substantially central portion of the recess 49 in the upper-lower direction and in the front-rear direction and has a circular shape in side view. The drum-shaft pass-through hole 50 has a diameter that is slightly larger than a diameter of a drum shaft 86 of the photosensitive drum 2.

As depicted in FIG. 1, the front portion 46 constitutes a front portion of the right sidewall 38. The front portion 46 extends frontward from a lower front end of the rear portion 45 and has a generally rectangular plate shape in side view.

As depicted in FIG. 3, the left sidewall 39 is disposed to the left of the right sidewall 38 and is spaced apart from the right sidewall 38. The left sidewall 39 has a generally L-shaped plate shape in side view. The left sidewall 39 includes a rear portion 51 and a front portion 52.

Figure 9:
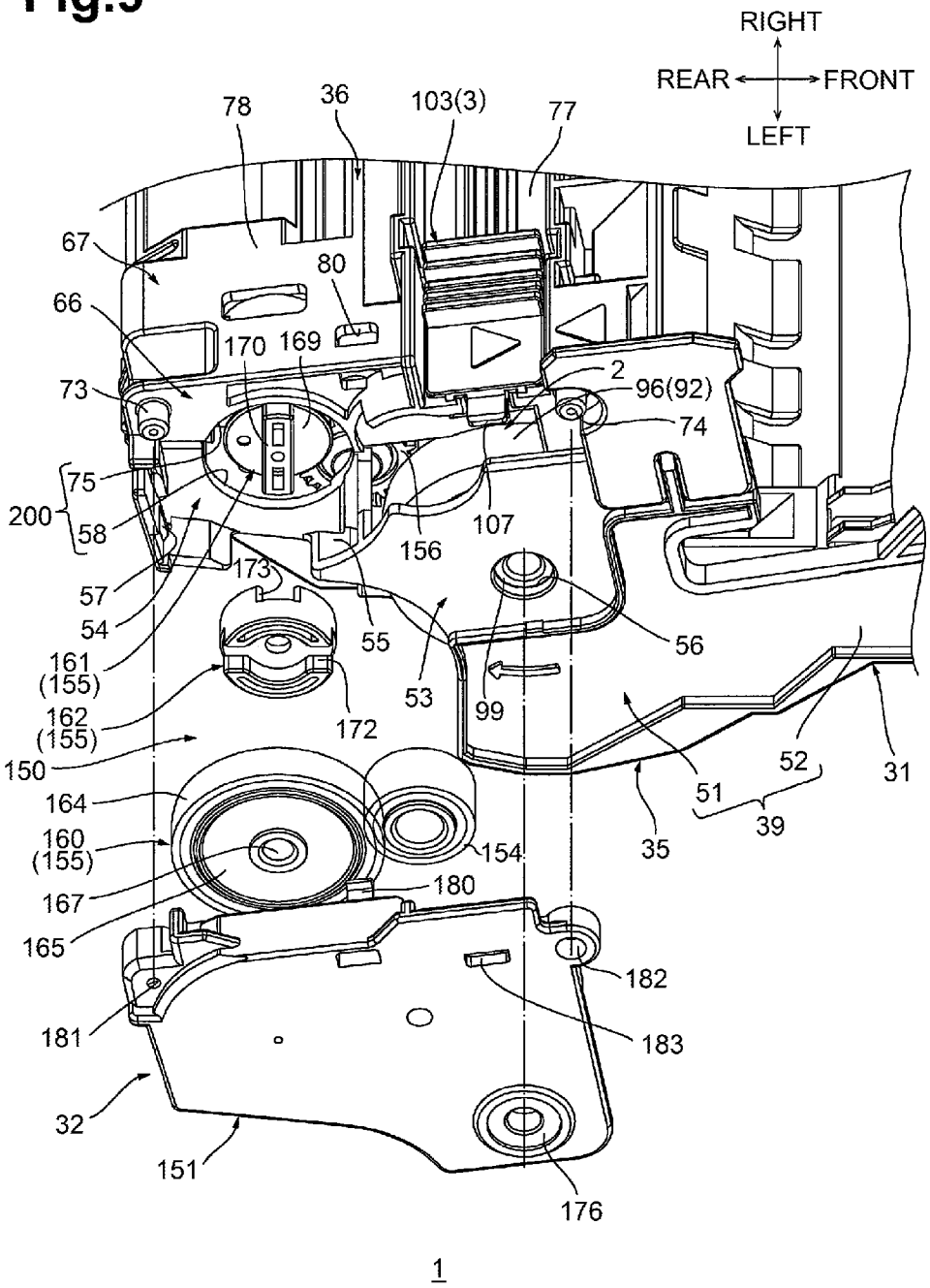
FIG. 9 is a disassembled perspective view depicting a drive unit depicted in FIG. 3 as viewed from the upper right in the illustrative embodiment according to one or more aspects of the disclosure.
Figure 12:
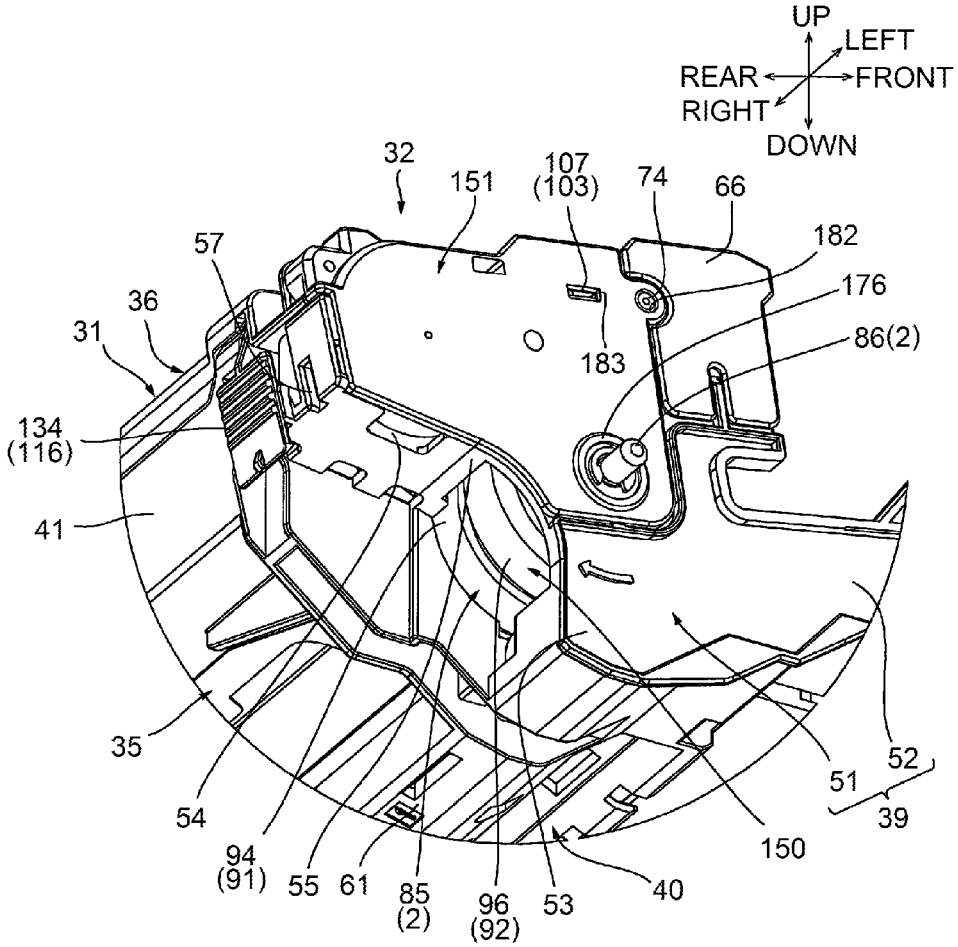
FIG. 12 is a perspective view depicting the drum cartridge depicted in FIG. 1 as viewed from the left rear in the illustrative embodiment according to one or more aspects of the disclosure.

The rear portion 51 constitutes a rear portion of the left sidewall 39. As depicted in FIGS. 9 and 12, the rear portion 51 has a crank-like shape in plan view. The rear portion 51 includes a first portion 53, a second portion 54, and a third portion 55.

The first portion 53 constitutes a front portion of the rear portion 51 of the left sidewall 39. As depicted in FIG. 9, the first portion 53 has a generally rectangular plate shape in side view. The first portion 53 has a larger-diameter through hole 56.

The larger-diameter through hole 56 penetrates through a substantially middle portion of the first portion 53 in side view and has a circular shape in side view. The larger-diameter through hole 56 has a diameter that is larger than the diameter of the drum-shaft pass-through hole 50 of the right sidewall 38. The center of the larger-diameter through hole 56 is coincide with the center of the drum-shaft pass-through hole 50 of the right sidewall 38 of the base frame 35 as viewed in the right-left direction.

As depicted in FIGS. 9 and 12, the second portion 54 constitutes a rear portion of the rear portion 51 of the left sidewall 39. The second portion 54 is disposed to the right of the first portion 53. The second portion 54 has a generally rectangular plate shape in side view. The second portion 54 includes a first retaining portion 57 and a semicircular portion 58.

The first retaining portion 57 has a generally rectangular plate shape in front view. The first retaining portion 57 protrudes leftward from a rear end of the second portion 54. The first retaining portion 57 has a through hole in its middle portion for catching a first hook 179 of a gear holder 151.

The semicircular portion 58 is disposed at a substantially middle portion of the second portion 54 in the front-rear direction. The semicircular portion 58 is recessed downward relative to an upper surface of the second portion 54 and has a generally semicircular shape in side view.

The third portion 55 is disposed between a rear end portion of the first portion 53 and a front end portion of the second portion 54. The third portion 55 has a generally rectangular plate shape in bottom view.

As depicted in FIG. 3, the front portion 52 constitutes a front portion of the left sidewall 39 of the base frame 35. The front portion 52 extends frontward from a lower front end of the rear portion 51 of the left sidewall 39 and has a generally rectangular plate shape in side view.

The bottom wall 40 is disposed such that its front portion is disposed between a lower end portion of the right sidewall 38 and a lower end portion of the left sidewall 39 and its rear portion is disposed between a substantially middle portion of the right sidewall 38 in the up-down direction and a substantially middle portion of the left sidewall 39 in the up-down direction as depicted in FIGS. 1 and 12. The bottom wall 40 has a crank-like shape in side view, and has a generally plate shape extending in the right-left direction. As depicted in FIGS. 1 and 4B, the bottom wall 40 includes a transfer-roller supporting portion 61 and a pair of guide ribs 62.

The transfer-roller supporting portion 61 is disposed in a rearward position at a middle portion of the bottom wall 40. The transfer-roller supporting portion 61 is recessed downward in the bottom wall 40 and has a generally U shape in side view. The transfer-roller supporting portion 61 supports the transfer roller 4 therein so as to be rotatable.

As depicted in FIG. 4B, the guide ribs 62 are spaced apart from each other in the right-left direction at a rear end portion of the bottom wall 40. The guide ribs 62 are disposed at right and left end portions, respectively, of the bottom wall 40. The guide ribs 62 protrude upward from an upper surface of the bottom wall 40 and have a generally rectangular plate shape in side view. Upper surfaces of the guide ribs 62 extend along the extending direction.

As depicted in FIGS. 1 and 3, the rear wall 41 of the base frame 35 is disposed between a rear end portion of the right sidewall 38 and a rear end portion of the left sidewall 39. A lower end of the rear wall 41 is contiguous to a rear end of the bottom wall 40. The rear wall 41 has a generally rectangular plate shape in rear view. As depicted in FIGS. 4B and 7A, the rear wall 41 includes a pair of release-lever supporting bosses 63.

The release-lever supporting bosses 63 are disposed above and to the rear of the guide ribs 62, respectively, of the bottom wall 40 and at right and left end portions, respectively, of an upper end portion of the rear wall 41. The release-lever supporting bosses 63 protrude rightward and leftward from the right and left end portions, respectively, of the rear wall 41. The release-lever supporting bosses 63 have a generally cylindrical shape.

As depicted in FIGS. 1 and 3, the front wall 42 of the base frame 35 is disposed between a front end portion of the right sidewall 38 and a front end portion of the left sidewall 39. A lower end of the front wall 42 is contiguous to a front end of the bottom wall 40. The front wall 42 has a generally rectangular plate shape in front view.

The cover frame 36 is disposed above a rear end portion of the base frame 35 while covering the photosensitive drum 2. As depicted in FIGS. 4A and 9, the cover frame 36 includes a right sidewall 65, a left sidewall 66, and a top wall 67, which are integrated with each other.

As depicted in FIG. 4A, the right sidewall 65 has a rectangular plate in side view. A lower surface of the right sidewall 65 extends along the extending direction. The right sidewall 65 includes a first concave portion 69, a second concave portion 70, and a projecting portion 71.

The first concave portion 69 is recessed upward relative to the lower surface at a rear end portion of the right sidewall 65. The first concave portion 69 has a generally U shape.

The second concave portion 70 is defined in front of the first concave portion 69 and is recessed upward relative to the lower surface of the right sidewall 65. The second concave portion 70 also has a generally U shape.

The projecting portion 71 is disposed in front of the second concave portion 70. The projecting portion 71 extends downward from the right sidewall 65 and has a generally rectangular plate shape in side view. The projecting portion 71 has a drum-shaft pass-through hole 72.

The drum-shaft pass-through hole 72 penetrates through a substantially central portion of the projecting portion 71 in the upper-lower direction and in the front-rear direction and has a circular shape in side view. The drum-shaft pass-through hole 72 has a diameter that is slightly larger than the diameter of the drum shaft 86 of the photosensitive drum 2.

As depicted in FIG. 9, the left sidewall 66 of the cover frame 36 has a generally rectangular plate shape in side view. The left sidewall 66 includes a first positioning boss 73, a second positioning boss 74, and a semicircular portion 75.

The first positioning boss 73 protrudes leftward from a rear end portion of a left surface of the left sidewall 66 and has a generally cylindrical shape.

The second positioning boss 74 protrudes leftward from a front end portion of the left surface of the left sidewall 66 and has a generally cylindrical shape.

The semicircular portion 75 is disposed in front of the first positioning boss 73 and is recessed upward relative to a lower surface of the left sidewall 66. The semicircular portion 75 has a generally semicircular shape in side view.

As depicted in FIGS. 1 and 3, the top wall 67 of the cover frame 35 is disposed between an upper end portion of the right sidewall 65 and an upper end portion of the left sidewall 66. As depicted in FIG. 1, the top wall 67 includes a charger supporting portion 77 and a rear portion 78.

The charger supporting portion 77 constitutes a front portion of the top wall 67. The charger supporting portion 77 extends in the right-left direction and has an inverted U-shape in side view. The charger supporting portion 77 includes the scorotron charger 3.

The rear portion 78 constitutes a rear portion of the top wall 67. The rear portion 78 has a generally rectangular plate shape in plan view extending in the right-left direction. As depicted in FIGS. 4B and 9, the rear portion 78 includes a second retaining portion 80, and a pair of guide ribs 81.

The second retaining portion 80 is disposed at a left rear end portion of the rear portion 78 of the top wall 67. The second retaining portion 80 penetrates through the rear portion 78 of the top wall 67 in the up-down direction for catching a second hook 180 of the gear holder 151 therein.

As depicted in FIG. 4B, the guide ribs 81 of the cover frame 36 are disposed at the rear portion 78 of the top wall 67 and are spaced apart from each other in the right-left direction. The guide ribs 81 are disposed at right and left end portions, respectively, of the rear portion 78 of the top wall 67. The guide ribs 81 protrude downward from a lower surface of the rear portion 78 and have a generally triangular shape in side view. Lower surfaces of the guide ribs 81 extend the extending direction.

As depicted in FIG. 3, the drum frame 31 includes the base frame 35 and the cover frame 36, in which the cover frame 36 is assembled to the base frame 35.

More specifically, the cover frame 36 is assembled to the base frame 35 such that, in the up-down direction, the right sidewall 65 of the cover frame 36 overlaps the rear portion 45 of the right sidewall 38 of the base frame 35, the left sidewall 66 of the cover frame 36 overlaps the rear portion 51 of the left sidewall 39 of the base frame 35, and a rear end portion of the rear portion 78 of the cover frame 36 overlaps the rear wall 41 of the base frame 35.

In this state, as depicted in FIGS. 4A and 6, in the right end portion of the drum frame 31, a lower end of the right sidewall 65 of the cover frame 36 is in contact with an upper end of the rear portion 45 of the right sidewall 38 of the base frame 35 and the projecting portion 71 of the right sidewall 65 of the cover frame 36 overlaps the right sidewall 38 of the base frame 35 as viewed in the right-left direction. Further, the drum-shaft pass-through hole 50 of the base frame 35 is coincide with the drum-shaft pass-through hole 72 of the cover frame 36 in the right-left direction.

As depicted in FIG. 4A, the first guide recess 47 of the right sidewall 38 of the base frame 35 faces the first concave portion 69 of the right sidewall 65 of the cover frame 36 in the up-down direction. Thus, the first guide recess 47 and the first concave portion 69 constitute a second-electrode receiving portion 202 for receiving a contact portion 145 of a second electrode 118. That is, the second-electrode receiving portion 202 extends in the up-down direction across a boundary of the base frame 35 and the cover frame 36.

The second guide recess 48 of the right sidewall 38 of the base frame 35 faces the second concave portion 70 of the right sidewall 65 of the cover frame 36 in the up-down direction. Thus, the second guide recess 48 and the second concave portion 70 constitute a first-electrode receiving portion 203 for receiving a contact portion 145 of a first electrode 117. The first-electrode receiving portion 203 is an example of a guide. That is, the first-electrode receiving portion 203 extends in the up-down direction across the boundary of the base frame 35 and the cover frame 36.

As depicted in FIGS. 6 and 9, in the left portion of the drum frame 31, a lower end of the left sidewall 66 of the cover frame 36 is in contact with an upper end of the left sidewall 39 of the base frame 35.

In this state, as depicted in FIG. 9, the semicircular portion 58 of the left sidewall 39 of the base frame 35 faces the semicircular portion 75 of the left sidewall 66 of the cover frame 35 in the up-down direction. Thus, the semicircular portion 58 of the left sidewall 39 of the base frame 35 and the semicircular portion 75 of the left sidewall 66 of the cover frame 35 define an opening 200 in which an Oldham coupling 155 is disposed.

As depicted in FIG. 4B, the upper surfaces of the guide ribs 62 of the bottom wall 40 of the base frame 35 face the lower surfaces of the guide ribs 81, respectively, of the top wall 67 of the cover frame 36 while being spaced apart therefrom at a certain interval in the attaching and detaching direction. Thus, the pair of guide ribs 62 and the pair of guide ribs 81 constitute a pair of roller shaft guides 201.

In the drum frame 31 configured as described above, as depicted in FIGS. 1 and 3, a first accommodating portion 204 is defined by the rear portion 45 of the right sidewall 38 of the base frame 35, the rear portion 51 of the left sidewall 39 of the base frame 35, the rear portion of the bottom wall 40 of the base frame 35, the rear wall 41 of the base frame 35, and the cover frame 36. The first accommodating portion 204 is configured to accommodate therein the photosensitive drum 2 and the cleaning unit 5.

In the drum frame 31, a second accommodating portion 205 is further defined by the front portion 46 of the right sidewall 38 of the base frame 35, the front portion 52 of the left sidewall 39 of the base frame 35, a front portion of the bottom wall 40 of the base frame 35, and the front wall 42 of the base frame 35. The second accommodating portion 205 is disposed in front of the first accommodating portion 204 and is configured to accommodate therein the developing cartridge 20.

(2) Photosensitive Drum

As depicted in FIG. 6, the photosensitive drum 2 includes a drum body 83, a pressing member 84, a bearing member 85, and a drum shaft 86. The drum shaft 86 is an example of a first rotating shaft.

The drum body 83 has a generally cylindrical shape extending in the right-left direction. The drum body 83 is disposed between the right sidewall 38 and the left sidewall 39 of the base frame 35. More specifically, the drum body 83 includes a metal base tube and a photosensitive resin layer. The base tube has a generally cylindrical shape extending in the right-left direction. The photosensitive layer covers a surface of the base tube.

The pressing member 84 is disposed at a right end portion of the drum body 83. The pressing member 84 includes a right flange 88, a frictional member 89, and a compression spring 90.

The right flange 88 has a generally cylindrical shape with its left end closed. The right flange 88 has an outside diameter that is substantially the same as an inside diameter of the drum body 83. The right flange 88 has a through hole in its central portion of the closed end. The through hole allows the drum shaft 86 to pass therethrough. The right flange 88 is fixed to the right end portion of the drum body 83 so as not be relatively rotatable.

The frictional member 89 has a generally cylindrical shape with its right end closed. The frictional member 89 has an outside diameter that is slightly smaller than an inside diameter of the right flange 88. The frictional member 89 has a through hole in its central portion of the closed end. The through hole allows the drum shaft 86 to pass therethrough. The frictional member 89 is fitted to a right end portion of the right flange 88 so as to be slidable therein in the right-left direction.

The compression spring 90 is a coil spring extending in the right-left direction. The compression spring 90 is disposed between the closed end of the right flange 88 and the closed end of the frictional member 89 in a compressed state.

Therefore, the compression spring 90 presses the drum body 83 leftward via the right flange 88 while pressing the frictional member 89 rightward.

The bearing member 85 is disposed at a left end portion of the drum body 83. The bearing member 85 includes a first left flange 91 and a second left flange 92.

The first left flange 91 includes a shaft pass-through portion 93 and a flange gear 94, which are integrated with each other.

The shaft pass-through portion 93 has generally cylindrical shape with its left end closed. The shaft pass-through portion 93 has an outside diameter that is substantially the same as the inside diameter of the drum body 83. The shaft pass-through portion 93 has a through hole in its central portion of the closed end. The through hole allows the drum shaft 86 to pass therethrough.

The flange gear 94 protrudes leftward from the left end of the shaft pass-through portion 93 contiguously and has a generally cylindrical shape. The flange gear 94 has an outside diameter that is larger than an outside diameter of the shaft pass-through portion 93.

The second left flange 92 is made of resin material, for example, polyacetal resin ("POM"). The second left flange 92 includes a drum gear 96, a disc portion 97, an engagement portion 98, and a smaller-diameter cylindrical portion 99. The drum gear 96 is an example of a photosensitive body gear.

The drum gear 96 has a generally cylindrical shape extending in the right-left direction. The drum gear 96 has an outside diameter that is larger than an outside diameter of the flange gear 94.

The disc portion 97 protrudes inwardly from a substantially central portion of the drum gear 96 in the diametric direction of the drum gear 96.

The engagement portion 98 protrudes rightward from a right surface of the disc portion 97 and has a generally cylindrical shape. The engagement portion 98 has an outside diameter that is substantially the same as the inside diameter of the flange gear 94. The engagement portion 98 has an inside diameter that is larger than the diameter of the drum shaft 86 and an outside diameter of the smaller-diameter cylindrical portion 99.

The smaller-diameter cylindrical portion 99 is hollow and penetrates through the center of the disc portion 97 in the right-left direction. The smaller-diameter cylindrical portion 99 has an outside diameter that is slightly smaller than an inside diameter of the larger-diameter through hole 56 of the left sidewall 39 of the base frame 35. The smaller-diameter cylindrical portion 99 has an inside diameter that is substantially the same as the outside diameter of the drum shaft 86. A left end of the smaller-diameter cylindrical portion 99 is located further to the left than a left end of the drum gear 96.

The drum shaft 86 extends in the right-left direction while passing through the center of the photosensitive drum 2 in the diametric direction. The drum shaft 86 has a generally cylindrical shape. The drum shaft 86 penetrates through the through hole of the pressing member 84 and the smaller-diameter cylindrical portion 99 of the bearing member 85.

The photosensitive drum 2 is rotatably positioned at a front portion of the first accommodating portion 204 of the drum frame 31 while a right end portion of the drum shaft 86 penetrates through the drum-shaft pass-through hole 72 of the right sidewall 65 and the drum-shaft pass-through hole 50 of the right sidewall 38 of the base frame 35 and a left end portion of the drum shaft 86 penetrates through the larger-diameter through hole 56 of the left sidewall 39 of the base frame 35.

In this state, the smaller-diameter cylindrical portion 99 of the bearing member 85 is positioned within the larger-diameter through hole 56 of the left sidewall 39 as viewed in the right-left direction.

(3) Scorotron Charger

As depicted in FIGS. 1 and 4B, the scorotron charger 3 is supported by the charger supporting portion 77 of the cover frame 36. Thus, the scorotron charger 3 is disposed above the photosensitive drum 2 and is spaced apart from the photosensitive drum 2. The scorotron charger 3 includes a charging wire 101, a grid 102, a wire cleaner 103, a charger electrode 104, and a grid electrode 105, as depicted in FIG. 4A.

As depicted in FIG. 1, the charging wire 101 extends in the right-left direction while being supported by the right sidewall 65 and the left sidewall 66 of the cover frame 36. The charging wire 101 is disposed above the photosensitive drum 2 and is spaced apart from the photosensitive drum 2.

The grid 102 has a U shape in side view. The grid 102 is disposed so as to surround the charging wire 101 from below.

As depicted in FIGS. 4B and 9, the wire cleaner 103 is disposed at an upper end portion of the charger supporting portion 77 and is supported so as to be slidable in the right-left direction for cleaning the charging wire 101. The wire cleaner 103 has a generally rectangular plate shape in plan view. The wire cleaner 103 includes a cleaner 106 and a protrusion 107.

As depicted in FIG. 4B, the cleaner 106 is disposed inside the grid 102. The cleaner 106 includes a cleaning member, e.g., a sponge or a nonwoven fabric, which pinches the charging wire 101. The cleaner 106 is movable along the charging wire 101.

As depicted in FIG. 9, the protrusion 107 protrudes leftward from a substantially middle portion of a left end portion of the cleaner 106 in the front-rear direction.

As depicted in FIG. 4A, the charger electrode 104 is electrically connected with the charging wire 101. The charger electrode 104 is exposed via the front end portion of the left sidewall 66 of the cover frame 36.

The grid electrode 105 is electrically connected with the grid 102. The grid electrode 105 is exposed via a substantially middle portion of the left sidewall 66 of the cover frame 36 in the front-rear direction.

(4) Cleaning Unit

As depicted in FIGS. 1 and 4B, the cleaning unit 5 includes the first roller 6, the second roller 7, the sponge scraper 8, the storage 9, a pair of bearings 114, a pair of urging members 115, a pair of release levers 116, the first electrode 117, and the second electrode 118.

The first roller 6 is disposed at a front end portion of the cleaning unit 5. The first roller 6 includes a first-roller shaft 121 and a first-roller body 122.

The first-roller shaft 121 has a generally cylindrical shape in the right-left direction. The first-roller shaft 121 has a diameter that is smaller than the width of the roller shaft guides 201. Each of right and left end portions of the first-roller shaft 121 is inserted into the roller shaft guides 201, respectively, from inside in the right-left direction.

The first-roller body 122 covers a substantially middle portion of the first-roller shaft 121 in the right-left direction and has a generally cylindrical shape. A lower-front surface of the first-roller body 122 is in contact with an upper-rear surface of the photosensitive drum 2.

The second roller 7 is disposed above and behind the first roller 6. The second roller 7 includes a second-roller shaft 124 and a second-roller body 125, which are integrated with each other.

The second-roller shaft 124 has a generally cylindrical shape extending in the right-left direction. The second-roller shaft 124 has a diameter that is smaller than a diameter of the first-roller shaft 121 and the width of the roller shaft guides 201. Each of right and left end portions of the second-roller shaft 124 is inserted into the roller shaft guides 201, respectively, from inside in the right-left direction.

The second-roller body 125 protrudes outward in a diametric direction of the second-roller shaft 124 from a substantially middle portion of the second-roller shaft 124 in the right-left direction. The second-roller body 125 has a diameter that is larger than a diameter of the second-roller shaft 124.

Figure 7B:
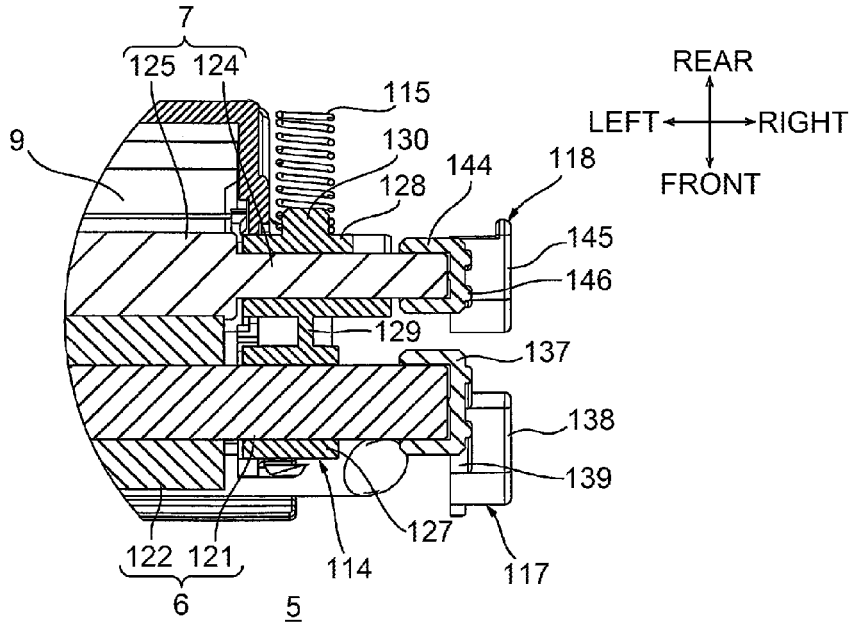
FIG. 7B is a cross sectional view of FIG. 7A, passing through the centers of first and second rollers in their diametric directions in the illustrative embodiment according to one or more aspects of the disclosure, wherein a base frame is omitted for convenience in drawing.

The bearings 114 are disposed within the corresponding roller shaft guides 201, respectively. As depicted in FIGS. 7A and 7B, each of the bearings 114 includes a first-roller-shaft pass-through portion 127, a second-roller-shaft pass-through portion 128, and a connecting portion 129.

The first-roller-shaft pass-through portion 127 has a generally cylindrical shape extending in the right-left direction. The first-roller-shaft pass-through portion 127 has an inside diameter that is substantially the same as an outside diameter of the first-roller shaft 121.

The second-roller-shaft pass-through portion 128 is disposed above and behind the first-roller-shaft pass-through portion 127. The second-roller-shaft pass-through portion 128 has a generally cylindrical shape extending in the right-left direction. The second-roller-shaft pass-through portion 128 includes a protrusion 130 (refer to FIG. 7B).

The protrusion 130 protrudes upwardly rearward from an upper rear surface of the second-roller-shaft pass-through portion 128. The protrusion 130 has a generally cylindrical shape.

The connecting portion 129 connects a lower front end portion of the first-roller-shaft pass-through portion 127 and an upper rear end portion of the second-roller-shaft pass-through portion 128. The connecting portion 129 extends in the extending direction and has a generally rectangular column shape.

The bearings 114 support the first-roller shaft 121 of the first roller 6 such that the first roller 6 is rotatable while both end portions of the first-roller shaft 121 pass through the first-roller-shaft pass-through portions 127 of the bearings 114, respectively. The bearings 114 further support the second-roller shaft 124 of the second roller 7 such that the second roller 7 is rotatable while both end portions of the second-roller shaft 124 pass through the second-roller-shaft pass-through portions 128 of the bearings 114, respectively.

As described above, the bearings 114 support the first roller 6 and the second roller 7 in the roller shaft guides 201, respectively, such that the first roller 6 and the second roller 7 are rotatable.

That is, the pair of bearings 114 is configured to be movable along the extending direction along with the first roller 6 and the second roller 7.

The urging members 115 are coil springs that extend in the extending direction. In each of the urging member 115, a lower front end portion is fitted to the protrusion 130 of a corresponding one of the bearings 114 and an upper rear end portion is in contact with an upper end portion of an inner surface of the rear wall 41 of the base frame 35.

With this configuration, the urging members 115 urge the respective bearings 114 downwardly frontward. That is, the urging members 115 are configured to urge the first roller 6 toward the photosensitive drum 2 such that the first roller 6 is kept in contact with the photosensitive drum 2.

As depicted in FIG. 3, the release levers 116 are disposed at both end portions of the drum frame 31 in the right-left direction. As depicted in FIGS. 4B and 7A, each of the release levers 116 includes a proximal portion 132, a hook 133, and a handle 134.

The proximal portion 132 has a generally obtuse triangular plate shape in side view. The proximal portion 132 has an obtuse-angled portion at its upper rear end in side view. The proximal portion 132 has an engagement hole 135.

The engagement hole 135 is defined in the obtuse-angled portion of the proximal portion 132 and has a circular shape in side view. The engagement hole 135 penetrates through the proximal portion 132. The engagement hole 135 has a diameter that is substantially the same as a diameter of the release-lever supporting bosses 63 of the rear wall 41.

The hook 133 is contiguous to a front end portion of the proximal portion 132 in side view. The hook 133 has a generally arc shape in side view. The hook 133 extends downward and curved in side view from a front end of the proximal portion 132. The radius of curvature of an inner surface of the hook 133 is slightly larger than a diameter of the second-roller shaft 124.

The handle 134 is contiguous to a rear end of the proximal portion 132 in side view. That is, the handle 134 is disposed opposite to the hook 133 with respect to the engagement hole 135. The handle 134 has a generally rectangular plate shape in rear view and extends in a direction perpendicular to a direction that the proximal portion 132 extends.

The release levers 116 are supported by the release-lever supporting bosses 63 of the rear wall 41 via the engagement holes 135, respectively. This configuration enables the release levers 116 to pivot on the respective release-lever supporting bosses 63.

Figure 5B:
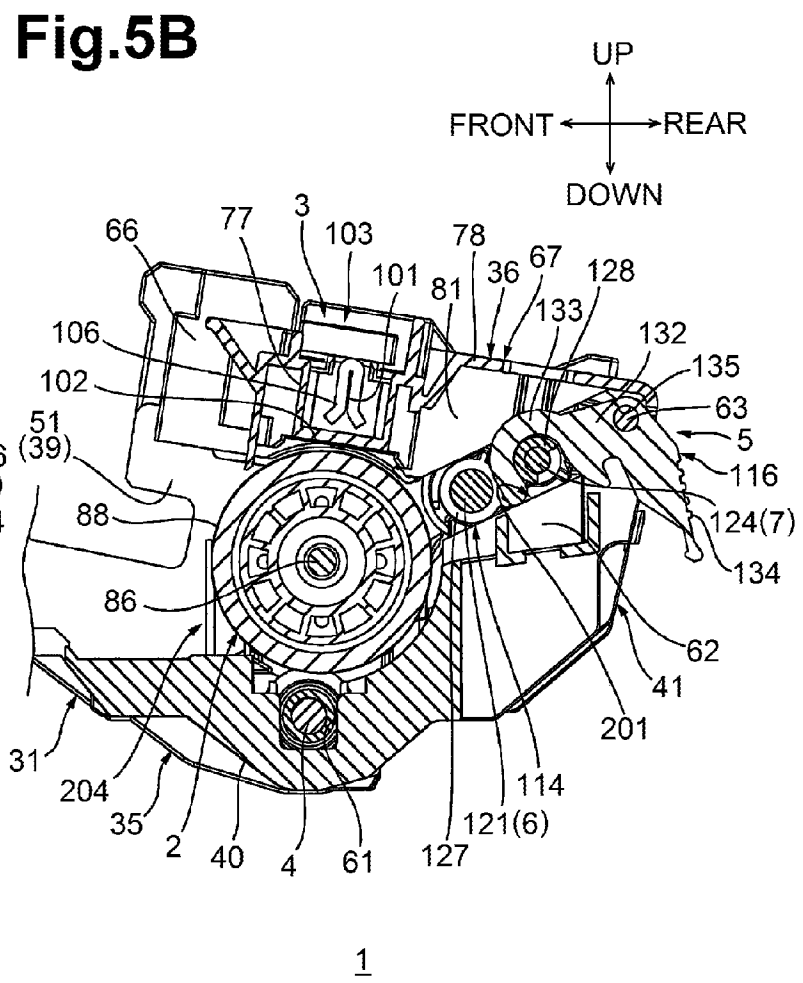
FIG. 5B is a side sectional view depicting of the rear portion of the drum cartridge depicted in FIG. 1 in the illustrative embodiment according to one or more aspects of the disclosure, wherein the pair of release levers is located at the second position.
Figure 5A:
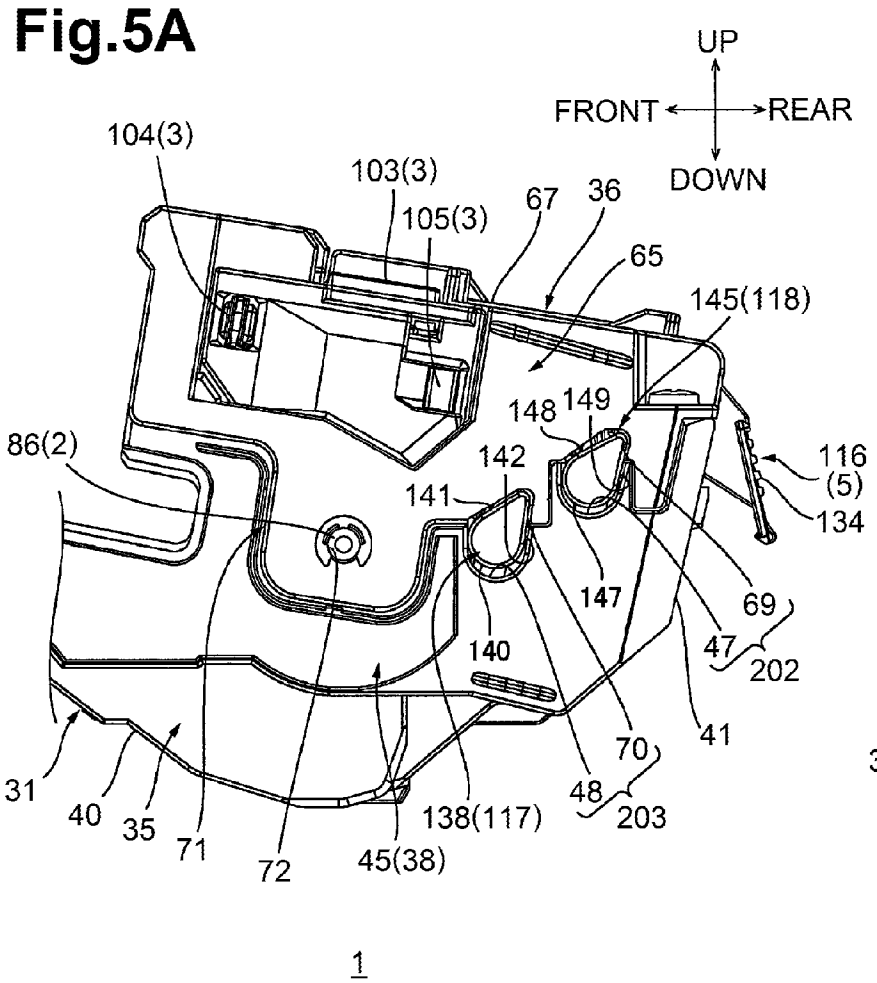
FIG. 5A is a right side view depicting of the rear portion of the drum cartridge depicted in FIG. 1 in the illustrative embodiment according to one or more aspects of the disclosure, wherein the pair of release levers is located at a second position.

More specifically, the pair of release levers 116 is pivotable between a first position and a second position. When the pair of release levers 113 is located at the first position, as depicted in FIG. 4B, the handles 134 extend along a rear surface of the rear wall 41 and the hooks 133 are located above the second-roller-shaft pass-through portions 128 of the bearings 114 with being spaced apart therefrom. When the pair of release levers 113 is located at the second position, as depicted in FIG. 5B, the handles 134 are located distant from the rear wall 41 and the hooks 133 are caught on the second-roller-shaft pass-through portions 128 of the bearings 114, respectively.

As depicted in FIG. 4B, when the pair of release levers 116 is located at the first position, the pair of bearings 114 is urged downwardly frontward by the pair of urging members 115 and thus the first roller 6 comes into contact with the upper rear surface of the photosensitive drum 2. As depicted in FIG. 5B, in response to the pivoting of the pair of release levers 116 from the first position to the second position, the pair of bearings 114 move upwardly rearward against the urging force of the pair of urging members 115 and thus the first roller 6 is separated from the photosensitive drum 2. The pair of release levers 116 is located at the first position at all times as depicted in FIG. 4B.

Figure 8A:
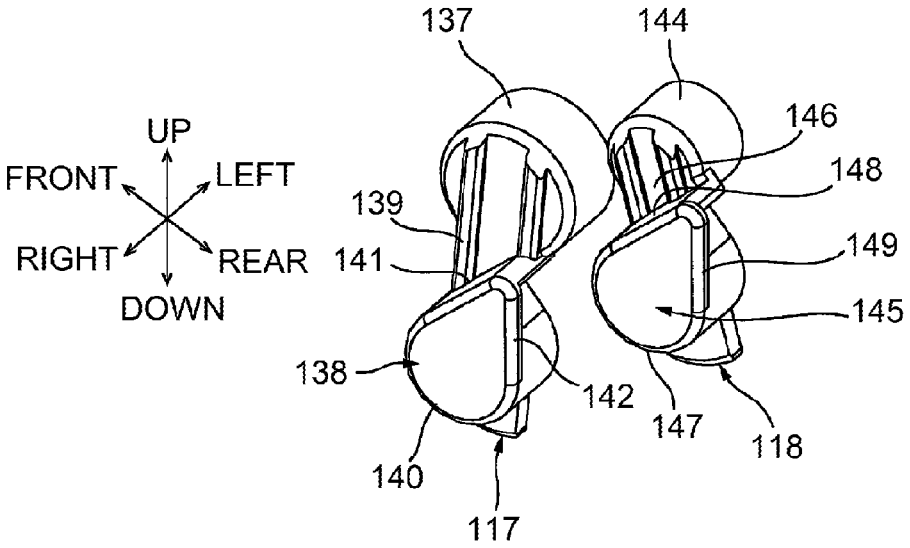
FIG. 8A is a perspective view depicting a first electrode and a second electrode depicted in FIG. 7A as viewed from the right rear in the illustrative embodiment according to one or more aspects of the disclosure.
Figure 8B:
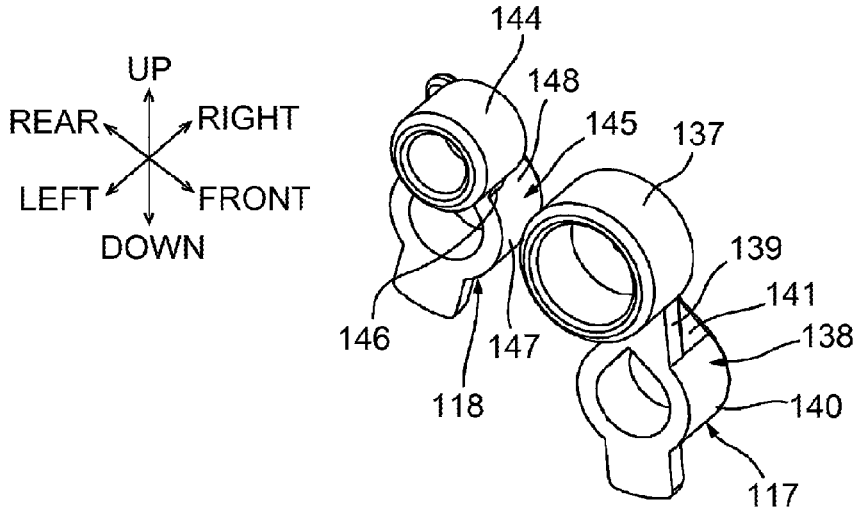
FIG. 8B is a perspective view depicting the first electrode and the second electrode depicted in FIG. 7A as viewed from the left front in the illustrative embodiment according to one or more aspects of the disclosure.

As depicted in FIG. 7A, the first electrode 117 is disposed at a right end portion of the cleaning unit 5. The first electrode 117 is made of conductive resin. The first electrode 117 is configured to supply first cleaning bias to the first roller 6 by establishing an electrical connection with a third apparatus electrode 193 of the main body 12. As depicted in FIGS. 8A and 8B, the first electrode 117 includes a roller-shaft supporting portion 137, a contact portion 138, and a connecting plate 139.

The roller-shaft supporting portion 137 has a generally cylindrical shape with its right end closed. The roller-shaft supporting portion 137 has an inside diameter that is substantially the same as the diameter of the first-roller shaft 121.

The contact portion 138 may be a drop-shaped hollow cylinder with its right end closed in side view. The contact portion 138 includes a curved portion 140, a first straight portion 141, and a second straight portion 142. A portion that constitutes a lower peripheral surface of the contact portion 138 and has a semicircular shape in side view is defined as the curved portion 140. A portion that constitutes a peripheral surface of the contact portion 138 and extends obliquely upward toward the rear from a front end of the curved portion 140 is defined as the first straight portion 141. A portion that constitutes a peripheral surface of the contact portion 138 and extends obliquely upward toward the front from a rear end of the curved portion 140 is defined as the second straight portion 142. The first straight portion 141 and the second straight portion 142 extend such that a distance therebetween becomes narrower toward their tips and their tips are in contact with each other. Therefore, the upper end of the first straight portion 141 is contiguous to the upper end of the second straight portion 142.

The connecting plate 139 connects a lower right end portion of the roller-shaft supporting portion 137 and an upper left end portion of the contact portion 138. The connecting plate 139 has a generally rectangular plate shape in side view.

As depicted in FIGS. 7A and 7B, the first electrode 117 is disposed such that the roller-shaft supporting portion 137 receives a left end portion of the first-roller shaft 121 so as to be rotatable and the contact portion 138 is positioned in the first-electrode receiving portion 203 as depicted in FIG. 4A.

The contact portion 138 of the first electrode 117 is disposed such that the contact portion 138 is positioned at a relatively lower position in the first-electrode receiving portion 203 when the pair of release levers 116 is located at the first position, i.e., when the first roller 6 is in contact with the upper rear surface of the photosensitive drum 2.

In this state, the curved portion 140 of the first electrode 117 is in contact with a lower portion of an inner surface of the first-electrode receiving portion 203, and the first straight portion 141 and the second straight portion 142 of the first electrode 117 are not in contact with any portion of the inner surface of the first-electrode receiving portion 203 and are spaced apart from the inner surface of the first-electrode receiving portion 203.

During movement of the pair of release levers 116 from the first position to the second position, the contact portion 138 of the first electrode 117 moves upward in the first-electrode receiving portion 203 while slightly turning substantially clockwise in right side view.

When the pair of release levers 116 is located at the second position, i.e., when the first roller 6 is separated from the photosensitive drum 2, the curved portion 140 of the first electrode 117 is in contact with a front portion of the inner surface of the first-electrode receiving portion 203, and the first straight portion 141 and the second straight portion 142 of the first electrode 117 are not in contact with any portion of the inner surface of the first-electrode receiving portion 203 and are spaced apart from the inner surface of the first-electrode receiving portion 203.

As described above, the first electrode 117 moves along the up-down direction in the first-electrode receiving portion 203 while slightly turning in side view in response to the movement of the pair of release levers 116 between the first position and the second position. That is, the first electrode 117 moves along a direction intersecting the direction that the first roller 6 moves, i.e., along a direction intersecting the extending direction while slightly turning.

As depicted in FIG. 7A, the second electrode 118 is disposed at a right end portion of the cleaning unit 5 and in front of and below the first electrode 117. The second electrode 118 is made of conductive resin. The second electrode 118 is configured to supply second cleaning bias to the second roller 7 by establishing an electrical connection with a fourth apparatus electrode 194 of the main body 12. As depicted in FIGS. 8A and 8B, the second electrode 118 includes a roller-shaft supporting portion 144, a contact portion 145, and a connecting plate 146.

The roller-shaft supporting portion 144 has a generally cylindrical shape with its right end closed. The roller-shaft supporting portion 144 has an inside diameter that is substantially the same as the diameter of the second-roller shaft 124.

The contact portion 145 may be a drop-shaped hollow cylinder with its right end closed in side view. The contact portion 145 includes a curved portion 147, a first straight portion 148, and a second straight portion 149. A portion that constitutes a lower peripheral surface of the contact portion 145 and has a semicircular shape in side view is defined as the curved portion 147. A portion that constitutes a peripheral surface of the contact portion 145 and extends obliquely upward toward the rear from a front end of the curved portion 147 is defined as the first straight portion 148. A portion that constitutes a peripheral surface of the contact portion 145 and extends obliquely upward toward the front from a rear end of the curved portion 147 is defined as the second straight portion 149. The first straight portion 148 and the second straight portion 149 extend such that a distance therebetween becomes narrower toward their tips and their tips are in contact with each other. Therefore, the upper end of the first straight portion 148 is contiguous to the upper end of the second straight portion 149.

The connecting plate 146 connects a lower right end portion of the roller-shaft supporting portion 144 and an upper left end portion of the contact portion 145. The connecting plate 146 has a generally rectangular plate shape in side view. The connecting plate 146 has a dimension in the up-down direction that is shorter than a dimension of the connecting plate 139 of the first electrode 117 in the up-down direction.

As depicted in FIGS. 7A and 7B, the second electrode 118 is disposed such that the roller-shaft supporting portion 144 receives a left end portion of the second-roller shaft 124 so as to be rotatable and the contact portion 145 is positioned in the second-electrode receiving portion 202 as depicted in FIG. 4A.

The contact portion 145 of the second electrode 118 is disposed such that the contact portion 145 is positioned at a relatively lower position in the second-electrode receiving portion 202 when the pair of release levers 116 is located at the first position, i.e., when the first roller 6 is in contact with the upper rear surface of the photosensitive drum 2.

In this state, the curved portion 147 of the second electrode 118 is in contact with a lower portion of an inner surface of the second-electrode receiving groove 202, and the first straight portion 148 and the second straight portion 149 of the second electrode 118 are not in contact with any portion of the inner surface of the second-electrode receiving portion 202 and are spaced apart from the inner surface of the second-electrode receiving groove 202.

During movement of the pair of release levers 116 from the first position to the second position, i.e., during movement of the first roller 6 away from the photosensitive drum 2 and upwardly rearward movement of the second roller 7 along with the first roller 6, the contact portion 145 of the second electrode 118 moves upward in the second-electrode receiving portion 202 while slightly turning substantially clockwise in right side view.

When the pair of release levers 116 is located at the second position, i.e., when the first roller 6 is separated from the photosensitive drum 2, the curved portion 147 of the second electrode 118 is in contact with a front portion of the inner surface of the second-electrode receiving groove 202, and the first straight portion 148 and the second straight portion 149 of the second electrode 118 are not in contact with any portion of the inner surface of the second-electrode receiving portion 202 and are spaced apart from the inner surface of the second-electrode receiving groove 202.

As described above, the second electrode 118 moves along the up-down direction in the second-electrode receiving portion 202 while slightly turning in side view in response to the movement of the pair of release levers 116 between the first position and the second position. That is, the second electrode 118 moves along a direction intersecting the direction that the second roller 7 moves, i.e., along a direction intersecting the extending direction while slightly turning.

In other words, the second electrode 118 behaves substantially the same in the second-electrode receiving portion 202 as the first electrode 117 behaves in the first-electrode receiving portion 203.

(5) Drive Unit

Figure 10:
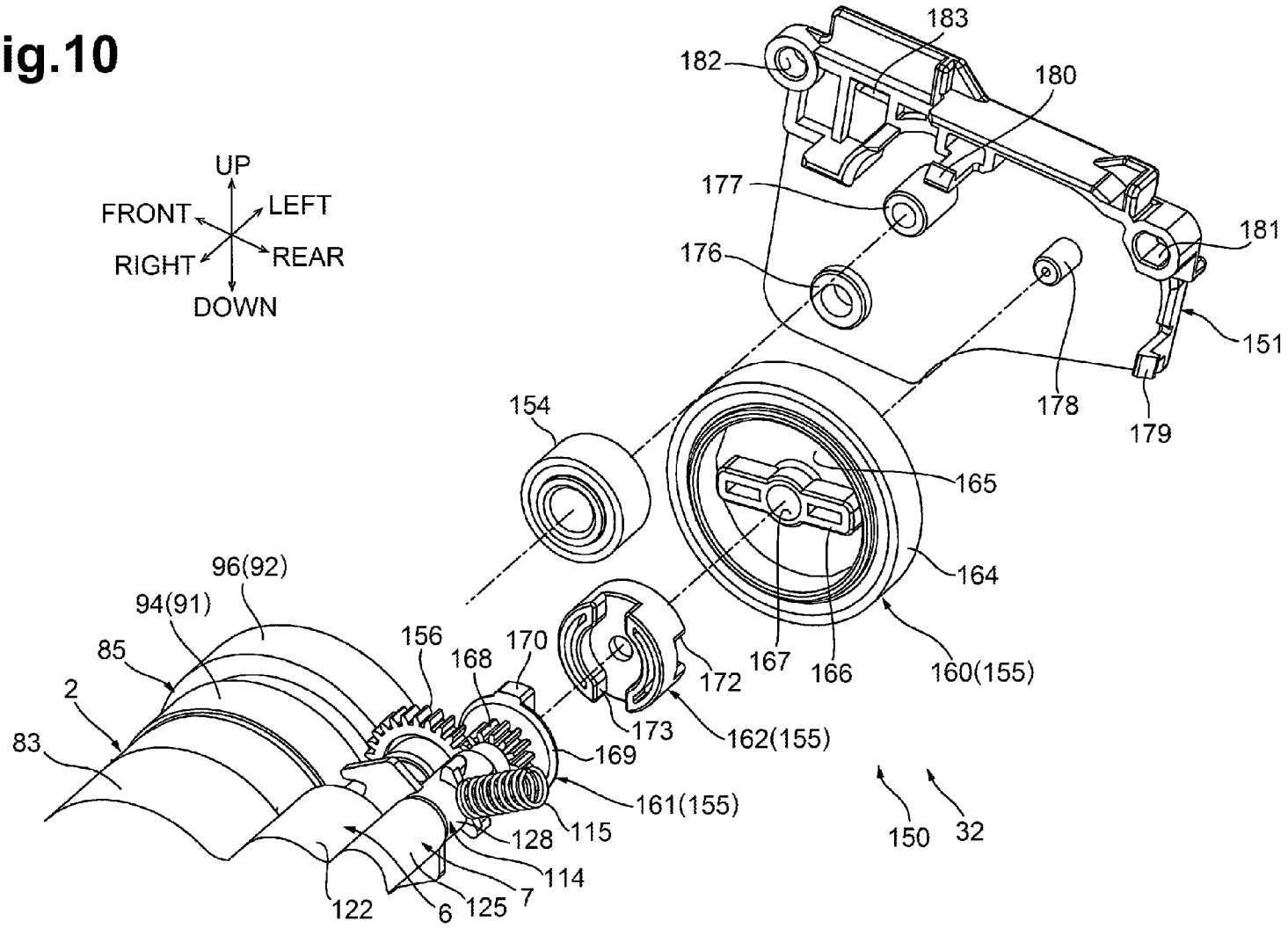
FIG. 10 is a disassembled perspective view depicting the drive unit depicted in FIG. 3 as viewed from the right rear in the illustrative embodiment according to one or more aspects of the disclosure, wherein a drum frame is omitted for convenience in drawing.

As depicted in FIGS. 9 and 10, the drive unit 32 is disposed at the left end of the drum cartridge 1. The drive unit 32 includes a power transmission mechanism 150 and a gear holder 151.

(5-1) Power Transmission Mechanism

The power transmission mechanism 150 is configured to transmit driving force to the photosensitive drum 2 and the first roller 6. The driving force is inputted from a drive source (not depicted) of the main body 12 of the image forming apparatus 1. The drive source is an example of an external drive source. The power transmission mechanism 150 includes the flange gear 94, the drum gear 96, a first idle gear 154, the Oldham coupling 155, a first roller gear 156, and a transfer roller gear 157 (refer to FIG. 6). The first roller gear 156 is an example of a first cleaning gear.

The flange gear 94 is supported by the left end portion of the drum body 83 so as not to be rotatable relative to the drum body 83. As depicted in FIG. 12, the flange gear 94 is disposed to the right of the second portion 54 of the rear portion 51 of the left sidewall 39 of the base frame 35.

Figure 11A:
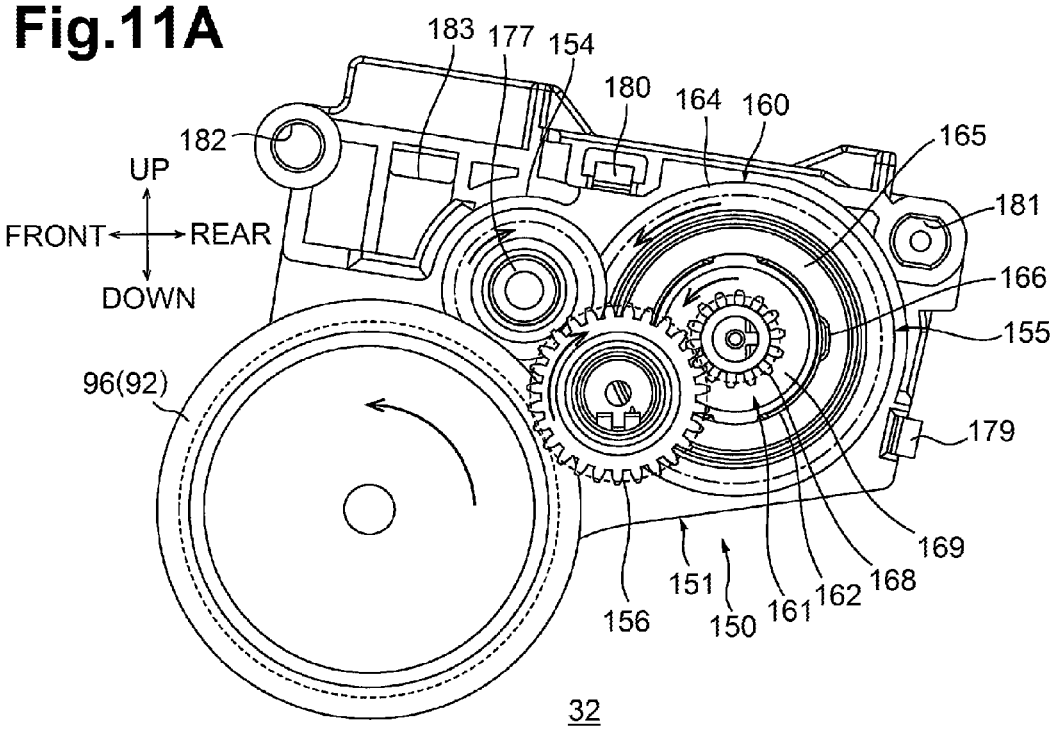
FIG. 11A is a right side sectional view depicting the drive unit depicted in FIG. 3 in the illustrative embodiment according to one or more aspects of the disclosure.

As depicted in FIGS. 6 and 12, the drum gear 96 is fitted to the flange gear 94 so as not to be rotatable relatively. The drum gear 96 is interposed between the first portion 53 and the second portion 54 of the rear portion 51 of the left sidewall 39 of the base frame 35 in the right-left direction. A lower rear portion of the drum gear 96 is exposed from the drum frame 31 and meshes with a drive gear (not depicted) of the main body 12. This configuration enables transmission of driving force from the drive source (not depicted) to the drum gear 96 via the drive gear (not depicted) of the main body 12. That is, the drum gear 96 is configured to input driving force transmitted from the drive source (not depicted) of the main body 12 to the photosensitive drum 2. The drum gear 96 rotates counterclockwise in right side view as depicted in FIG. 11A.

Figure 11B:
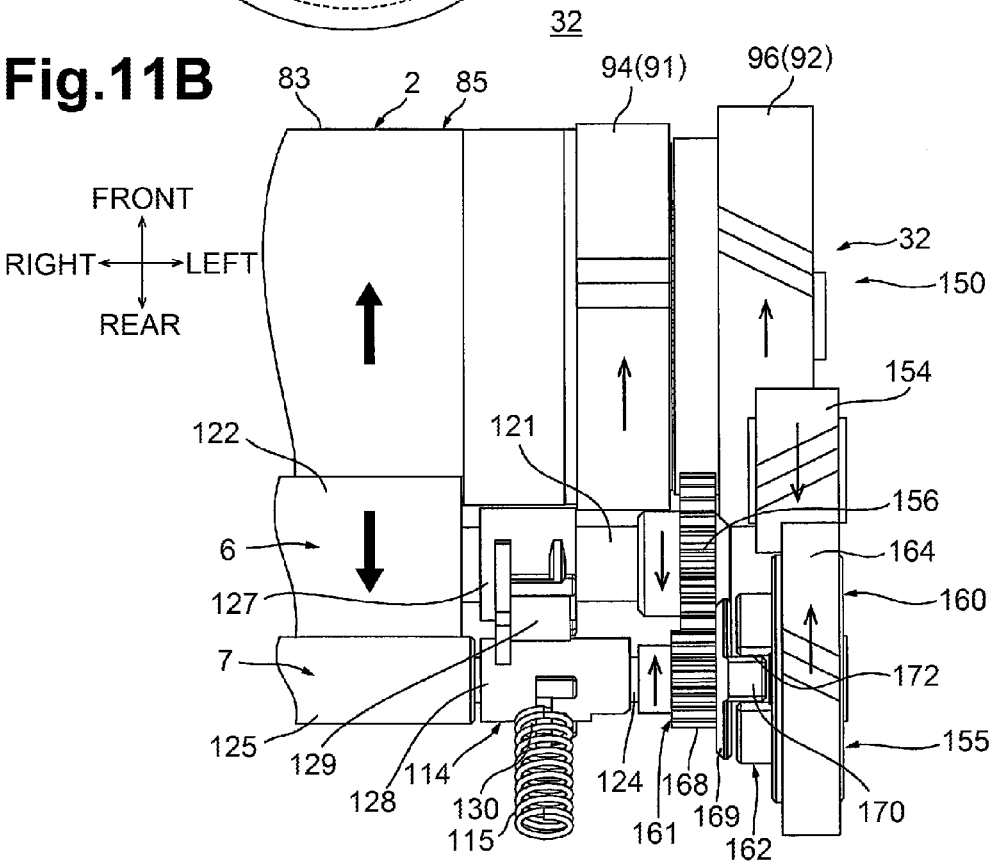
FIG. 11B is a top plan view depicting a power transmission mechanism depicted in FIG. 11A in the illustrative embodiment according to one or more aspects of the disclosure, wherein a drum frame and a gear holder are omitted for convenience in drawing.

As depicted in FIGS. 9 and 10, the first idle gear 154 has a generally cylindrical shape extending in the right-left direction. A lower front portion of the first idle gear 154 meshes with an upper rear portion of the drum gear 96 as depicted in FIGS. 11A and 11B. The first idle gear 154 rotates clockwise in right side view as depicted in FIG. 11A.

As depicted in FIGS. 9 and 10, the Oldham coupling 155 includes a larger-diameter hub 160, a smaller-diameter hub 161, and a slider 162.

The larger-diameter hub 160 constitutes a left portion of the Oldham coupling 155. The larger-diameter hub 160 includes a second idle gear 164, a closed portion 165, and a projection 166, which are integrated with each other. The larger-diameter hub 160 further has a through hole 167. The second idle gear 164 is an example of a third intermediate gear.

The second idle gear 164 has a generally cylindrical shape extending in the right-left direction. The second idle gear 164 has a diameter that is smaller than an outside diameter of the drum gear 96 and is larger than an outside diameter of the first idle gear 154. A front portion of the second idle gear 164 meshes with a rear portion of the first idle gear 154 as depicted in FIGS. 11A and 11B. The second idle gear 164 rotates counterclockwise in right side view as depicted in FIG. 11A.

As depicted in FIGS. 9 and 10, the closed portion 165 has a generally disc shape in side view and closes a left end of the second idle gear 164.

As depicted in FIG. 10, the projection 166 protrudes rightward from a right surface of the closed portion 165 and extends along a diametric direction of the closed portion 165.

As depicted in FIGS. 9 and 10, the through hole 167 penetrates through substantially centers of the closed portion 165 and the projection 166 in side view. The through hole 167 has a generally circular shape in side view.

The smaller-diameter hub 161 constitutes a right portion of the Oldham coupling 155. The smaller-diameter hub 161 includes a second roller gear 168, a disc portion 169, and a projection 170, which are integrated with each other. The second roller gear 168 is an example of a second cleaning gear.

The second roller gear 168 constitutes a right portion of the smaller-diameter hub 161, and has a generally cylindrical shape extending in the right-left direction. The second roller gear 168 has a diameter that is smaller than a diameter of the second idle gear 164. The second roller gear 168 is attached to the left end portion of the second-roller shaft 124 so as not to be rotatable relatively. That is, the second roller gear 168 is configured to input driving force to the second roller 7. The driving force is transmitted from the drive source (not depicted) of the main body 12.

The disc portion 169 constitutes a substantially middle portion of the second roller gear 168 in the right-left direction. The disc portion 169 is disposed to the left of the second roller gear 168 adjacently. The disc portion 169 is coaxial with the second roller gear 168. The disc portion 169 has a diameter that is larger than a diameter of the second roller gear 168 and is smaller than the diameter of the second idle gear 164.

The projection 170 constitutes a right portion of the second roller gear 168. The projection 170 protrudes leftward from a left surface of the disc portion 169 and extends in a diametric direction of the disc portion 169.

The slider 162 is interposed between the larger-diameter hub 160 and the smaller-diameter hub 161. The slider 162 has a generally cylindrical shape extending in the right-left direction. The slider 162 has a first groove 172 and a second groove 173.

The first groove 172 is recessed rightward relative to a left surface of the slider 162 and extends along a diametric direction of the slider 162. The first groove 172 has a width that is slightly wider than a width of the projection 166 of the larger-diameter hub 160.

The second groove 173 is recessed leftward relative to a right surface of the slider 162 and extends along the diametric direction of the slider 162. The second groove 173 has a width that is slightly wider than a width of the projection 170 of the smaller-diameter hub 161. The second groove 173 extends in a direction perpendicular to a direction that the first groove 172 extends as viewed in the right-left direction.

The first groove 172 of the slider 162 receives therein the projection 166 of the larger-diameter hub 160 and the second groove 173 of the slider 162 receives therein the projection 170 of the smaller-diameter hub 161, thereby constituting the Oldham coupling 155. That is, the Oldham coupling 155 includes the second idle gear 164 and the second roller gear 168.

With this configuration, the slider 162 slides relative to the projection 166 of the larger-diameter hub 160 and the projection 170 of the smaller-diameter hub 161, whereby the second idle gear 164 and the second roller gear 168 rotate interlocked with each other even when their rotating axes are deviated. Thus, driving force inputted into the second idle gear 164 is surely transmitted to the second roller gear 168. As depicted in FIG. 11A, the second roller gear 168 rotates counterclockwise in right side view in a similar manner to the second idle gear 164.

The Oldham coupling 155 is disposed such that the Oldham coupling 155 extends across the inside and the outside of the first accommodating portion 204 of the drum frame 31 via the opening 200.

As depicted in FIGS. 10 and 11B, the first roller gear 156 has a generally cylindrical shape extending in the right-left direction. The first roller gear 156 has a diameter that is larger than the diameter of the second roller gear 168. The first roller gear 156 is attached to the left end portion of the first-roller shaft 121 so as not to be rotatable relatively. As depicted in FIGS. 11A and 11B, the first roller gear 156 is disposed between the drum gear 96 and the Oldham coupling 155 in the extending direction. An upper front portion of the first roller gear 156 overlaps a lower rear portion of the first idle gear 154 as viewed in the right-left direction. An upper rear portion of the first roller gear 156 meshes with a lower front portion of the second roller gear 168. That is, the first roller gear 156 is configured to input driving force, which is transmitted from the drive source of the main body 12, to the first roller 6. As depicted in FIG. 11A, the first roller gear 156 rotates clockwise in right side view.

As depicted in FIG. 6, the transfer roller gear 157 is disposed at a left end portion of the transfer roller 4. The transfer roller gear 157 has a generally cylindrical shape extending in the right-left direction. An upper portion of the transfer roller gear 157 meshes with a lower portion of the flange gear 94.

(5-2) Gear Holder

As depicted in FIGS. 9 and 10, the gear holder 151 is a separate part from the drum frame 31. The gear holder 151 is disposed to the left of the power transmission mechanism 150 in the drive unit 32. The gear holder 151 has a generally rectangular plate shape in side view. The gear holder 151 is made of, for example, resin material, e.g., acrylonitrile butadiene styrene ("ABS"), or metal. The material, e.g., polyacetal resin ("POM"), used for the gear holder 151 has higher heat resistance and higher abrasion resistance to the material used for the second left flange 92 than the material, e.g., polystyrene ("PS"), used for the base frame 35. The gear holder 151 includes a drum-shaft supporting portion 176, a first-idle-gear supporting portion 177, a larger-diameter-hub supporting portion 178, a first hook 179, and a second hook 180. The gear holder 151 further has a first boss hole 181 and a second boss hole 182.

The drum-shaft supporting portion 176 protrudes rightward from the right surface of the gear holder 151 at a lower front portion of the gear holder 151. The drum-shaft supporting portion 176 has a generally cylindrical shape. The drum-shaft supporting portion 176 has an outside diameter that is substantially the same diameter of the larger-diameter through hole 56 in the left sidewall 39 of the base frame 35. The drum-shaft supporting portion 176 has an inside diameter that is substantially the same as the diameter of the drum shaft 86.

The first-idle-gear supporting portion 177 is disposed at a substantially middle portion of the gear holder 151 in the front-rear direction and above and behind the drum-shaft supporting portion 176. The first-idle-gear supporting portion 177 protrudes rightward from the right surface of the gear holder 151 and has a generally cylindrical shape. The drum-shaft supporting portion 176 has a diameter that is substantially the same as an inside diameter of the first idle gear 154.

The larger-diameter-hub supporting portion 178 is disposed at the rear portion of the gear holder 151 and at a substantially middle portion of the gear holder 151 in the front-rear direction. The larger-diameter-hub supporting portion 178 is further disposed behind and below the first-idle-gear supporting portion 177. The larger-diameter-hub supporting portion 178 protrudes rightward from the right surface of the gear holder 151 and has a generally cylindrical shape. The larger-diameter-hub supporting portion 178 has a diameter that is substantially the same as a diameter of the through hole 167 of the larger-diameter hub 160.

The first hook 179 is disposed at a lower rear end portion of the gear holder 151 and behind and below the larger-diameter-hub supporting portion 178. The first hook 179 protrudes rightward from the right surface of the gear holder 151. The first hook 179 is bent at a particular portion and further extends rearward.

The second hook 180 is disposed at a substantially middle portion of the gear holder 151 in the front-rear direction. The second hook 180 is further disposed behind and above the first-idle-gear supporting portion 177 and in front of and above the larger-diameter-hub supporting portion 178. The second hook 180 protrudes rightward from the right surface of the gear holder 151. The second hook 180 is bent at a particular portion and further extends upward.

The first boss hole 181 is defined in an upper rear end portion of the gear holder 151. The first boss hole 181 penetrates through the gear holder 151 and has an oval shape in side view.

The second boss hole 182 is defined in an upper front end portion of the gear holder 151. The second boss hole 182 penetrates through the gear holder 151 and has a circular shape in side view.

The wire-cleaner retaining portion 183 is disposed at an upper end portion of the gear holder 151 and between the second boss hole 182 and the first-idle-gear supporting portion 177. The wire-cleaner retaining portion 183 has a generally rectangular shape in side view and includes an opening that penetrates through the gear holder 151.

The gear holder 151 is attached to the drum frame 31 from the left and covers the power transmission mechanism 150.

More specifically, the gear holder 151 supports the first idle gear 154 and the larger-diameter hub 160 including the second idle gear 164 while the first-idle-gear supporting portion 177 penetrates through the first idle gear 154 and the larger-diameter-hub supporting portion 178 penetrates through the through hole 167 of the larger-diameter hub 160 of the Oldham coupling 155.

The drum-shaft supporting portion 176 receives the drum shaft 86 of the photosensitive drum 2 while passing through the larger-diameter through hole 56 of the left sidewall 39 of the base frame 35.

A left end surface of the drum-shaft supporting portion 176 is flush with the right surface of the first portion 53 of the rear portion 51. Thus, the left end surface of the drum-shaft supporting portion 176 contacts a left end surface of the smaller-diameter cylindrical portion 99 of the second left flange 92 of the bearing member 85.

The first boss hole 181 receives the first positioning boss 73 of the left sidewall 66 of the cover frame 36 and the second boss hole 182 receives the second positioning boss 74 of the left sidewall 66 of the cover frame 36, thereby positioning the gear holder 151 with respect to the drum frame 31.

The first hook 179 is caught on the first retaining portion 57 of the second portion 54 of the rear portion 51 of the left sidewall 39 and the second hook 180 is caught on the second retaining portion 80 of the rear portion 78 of the top wall 67 of the cover frame 36. That is, the gear holder 151 connects the base frame 35 and the cover frame 36 with each other.

As described above, the gear holder 151 is assembled to the drum frame 31 while protecting the power transmission mechanism 150.

As depicted in FIG. 6, a lower portion of the gear holder 151 overlaps an upper portion of the left sidewall 39 as viewed in the right-left direction.

When the wire cleaner 103 of the scorotron charger 3 is located at a left end portion of the charger supporting portion 77, the protrusion 107 of the wire cleaner 103 is in engagement with the wire-cleaner retaining portion 183.

With this configuration, the position of the wire cleaner 103 is fixed while the wire cleaner 103 is not used.

(5-3) Transmission of Driving Force from Drive Source

As depicted in FIGS. 11A and 11B, as driving force is transmitted to the drum gear 96 from the drive gear (not depicted) of the main body 12, the drum gear 96 rotates counterclockwise in right side view. The drum gear 96 thus transmits the driving force to the first idle gear 154.

As the driving force is transmitted to the first idle gear 154 from the drum gear 96, the first idle gear 154 rotates clockwise in right side view. The first idle gear 154 thus transmits the driving force to the second idle gear 164 of the larger-diameter hub 160 of the Oldham coupling 155.

In the Oldham coupling 155, as the driving force is transmitted to the second idle gear 164 of the larger-diameter hub 160 from the first idle gear 154, the larger-diameter hub 160 rotates counterclockwise in right side view. The larger-diameter hub 160 thus transmits the driving force to the smaller-diameter hub 161 via the slider 162.

As the driving force is transmitted to the smaller-diameter hub 161 from the larger-diameter hub 160, the second roller gear 168 of the smaller-diameter hub 161 rotates counterclockwise in right side view in a similar manner to the second idle gear 164. The second roller gear 168 of the smaller-diameter hub 161 thus transmits the driving force to the first roller gear 156.

As the driving force is transmitted to the first roller gear 156 from the first roller gear 156, the first roller gear 156 rotates clockwise in right side view.

Thus, the photosensitive drum 2, which is configured to rotate in response to input of driving force to the drum gear 96, rotates counterclockwise in right side view and the first roller 6, which is configured to rotate clockwise in right side view in response to input of driving force to the first roller gear 156, rotates clockwise in right side view. That is, the photosensitive drum 2 and the first roller 6 rotate in the same direction at their contacting point.

As described above, the number of rotations of the first roller gear 156 with respect to the number of rotations of the drum gear 96 is reduced via the first idle gear 154, the second idle gear 164, and the second roller gear 168 of the power transmission mechanism 150. Thus, a ratio of a peripheral speed of the first roller 6 relative to the photosensitive drum 2 becomes approximately 0.3. In other words, the first idle gear 154, the second idle gear 164, and the second roller gear 168 constitute a reduction mechanism.

The photosensitive drum 2 rotates while being pressed toward the left. Therefore, the left end surface of the smaller-diameter cylindrical portion 99 of the photosensitive drum 2 is rubbed against the right end surface of the drum-shaft supporting portion 176 of the power transmission mechanism 150.

As described above, the smaller-diameter cylindrical portion 99 of the second left flange 92 is made of polyacetal resin ("POM") and the drum-shaft supporting portion 176 of the gear holder 151 is made of acrylonitrile butadiene styrene ("ABS"). The smaller-diameter cylindrical portion 99 of the second left flange 92 is made of polyacetal resin ("POM") and the left sidewall 39 of the base frame 35 of the drum frame 31 is made of polystyrene ("PS"). A threshold value that the rubbing surfaces of the smaller-diameter cylindrical portion 99 and the drum-shaft supporting portion 176 deform or melt due to heat generated by friction is higher than a threshold value that the rubbing surfaces of the smaller-diameter cylindrical portion 99 of the second left flange 92 and the left sidewall 39 of the base frame 35 of the drum frame 31 deform or melt due to heat generated by friction.

4. Details of Main Body of Image Forming Apparatus

Figure 14A:
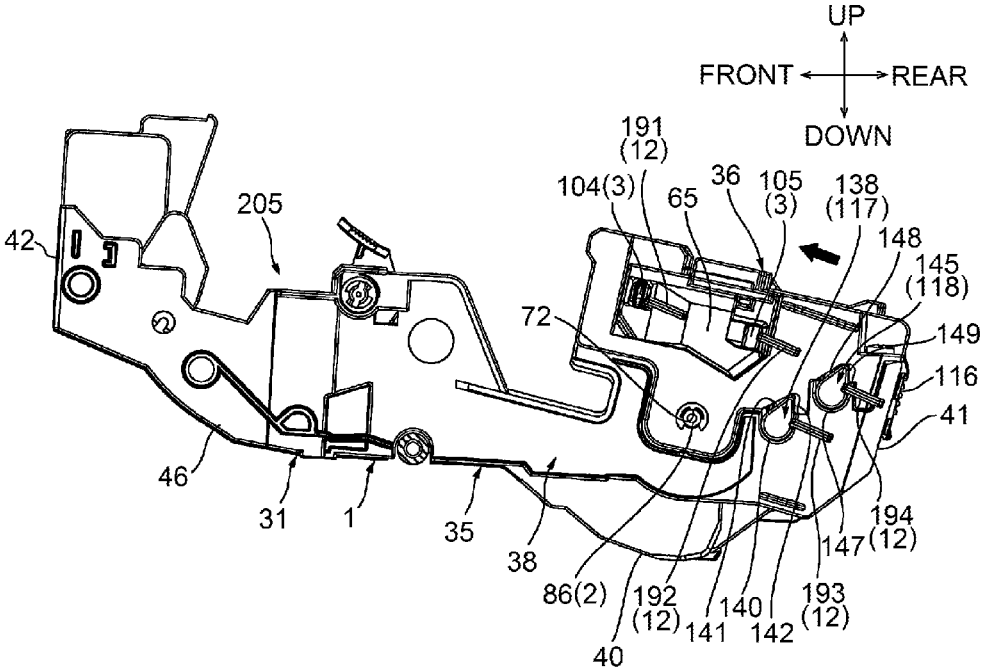
FIG. 14A illustrates an intermediate state of the drum cartridge with respect to the main body in the installation procedure, subsequent to the initial state depicted in FIG. 13B, in the illustrative embodiment according to one or more aspects of the disclosure.
Figure 14B:
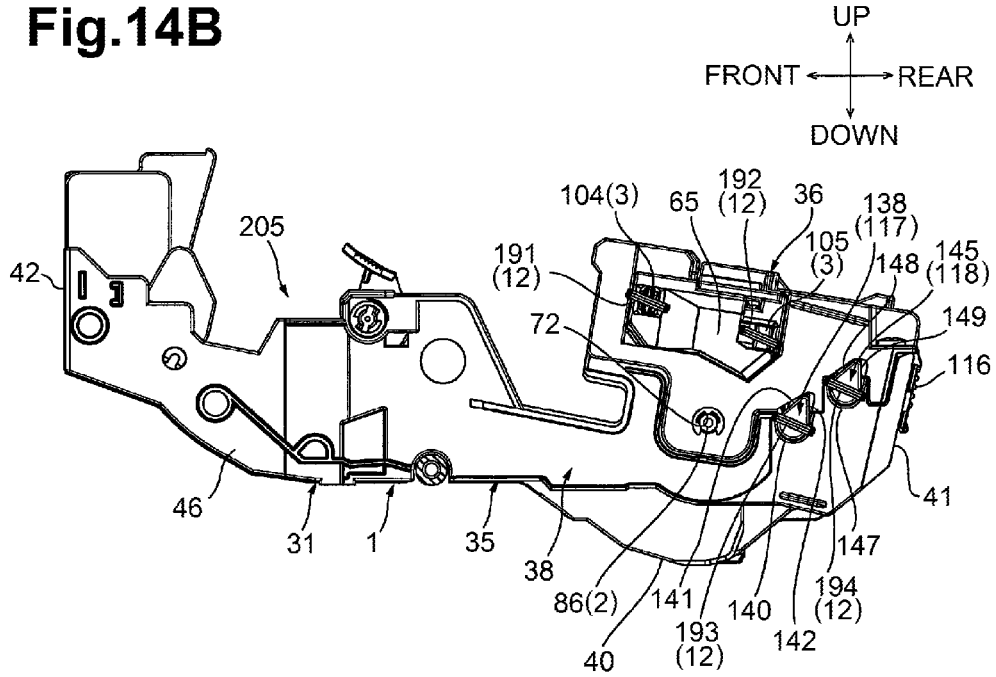
FIG. 14B illustrates a state of the drum cartridge with respect to the main body in the installation procedure at the time of completion of the installation of the drum cartridge in the main body in the illustrative embodiment according to one or more aspects of the disclosure.

As depicted in FIG. 14B, the main body 12 includes a first apparatus electrode 191, a second apparatus electrode 192, the third apparatus electrode 193, and the fourth apparatus electrode 194.

The first apparatus electrode 191 is disposed such that the first apparatus electrode 191 is in contact with the charger electrode 104 in the right-left direction in a state where the drum cartridge 1 is installed and positioned at a particular position in the main body 12.

The second apparatus electrode 192 is disposed such that the second apparatus electrode 192 is in contact with the grid electrode 105 in the right-left direction in the state where the drum cartridge 1 is installed in the main body 12.

The third apparatus electrode 193 is disposed such that the third apparatus electrode 193 is in contact with the contact portion 138 of the first electrode 117 in the right-left direction in the state where the drum cartridge 1 is installed and positioned at the particular position in the main body 12.

The fourth apparatus electrode 194 is disposed such that the fourth apparatus electrode 194 is in contact with the contact portion 145 of the second electrode 118 in the right-left direction in the state where the drum cartridge 1 is installed and positioned at the particular position in the main body 12.

The first apparatus electrode 191, the second apparatus electrode 192, the third apparatus electrode 193, and the fourth apparatus electrode 194 are configured to be movable in the right-left direction and are urged leftward at all times. The first apparatus electrode 191, the second apparatus electrode 192, the third apparatus electrode 193, and the fourth apparatus electrode 194 are electrically connected with a power supply (not depicted) of the main body 12.

5. Installation and Removal of Drum Cartridge with Respect to Main Body of Image Forming Apparatus A procedure to install the drum cartridge 1 to the main body 12 of the image forming apparatus 1 will be described.

In order to install the drum cartridge 1 to the main body 12, as a first step, as depicted in FIG. 2, an operator positions the developing cartridge 20 in the second accommodating portion 205 of the drum cartridge 1 to assemble the process cartridge 13.

Then, the operator opens the front cover 17 and inserts the process cartridge 13 into the main body 12 via the opening 16 from an upper front position with respect to the main body 12.

In response to this, as depicted in FIG. 13A, the first apparatus electrode 191 moves upwardly frontward relative to the drum cartridge 1 so as to be situated below the grid electrode 105 while sliding over the right surface of the right sidewall 65 of the cover frame 36.

Further, the second apparatus electrode 192 moves upwardly frontward relative to the drum cartridge 1 so as to be situated behind the curved portion 147 of the contact portion 145 of the second electrode 118 while sliding over the right surface of the right sidewall 38 of the base frame 35 and the right surface of the right sidewall 65 of the cover frame 36.

Meanwhile, the third apparatus electrode 193 and the fourth apparatus electrode 194 are not in contact with the right sidewall 38 and are situated behind the drum cartridge 1.

Figure 13B:
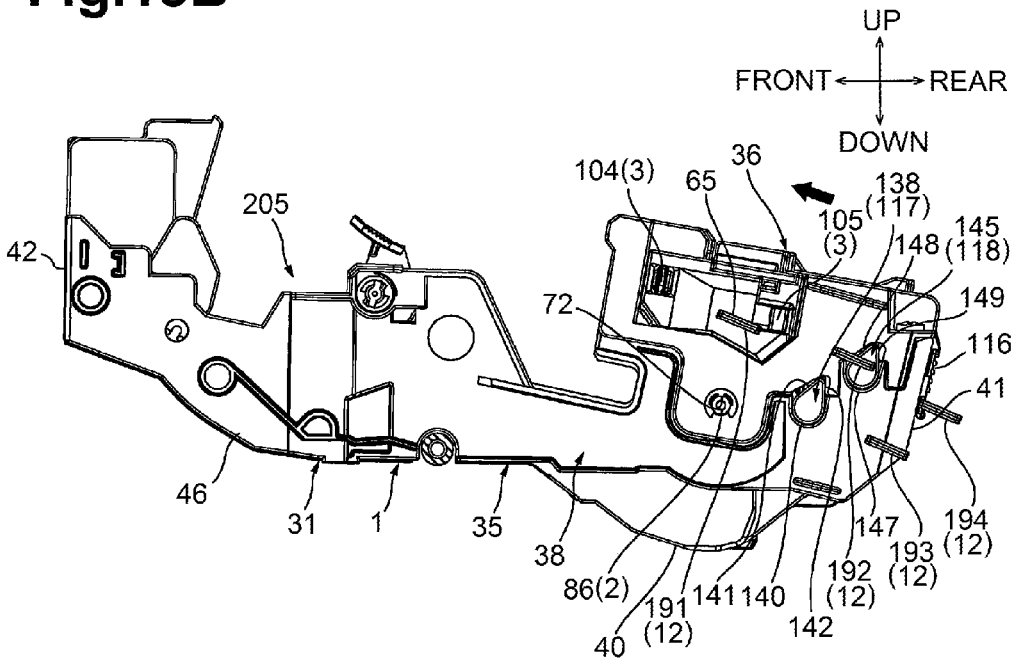
FIG. 13B illustrates an intermediate state of the drum cartridge with respect to the main body in the installation procedure, subsequent to the initial state depicted in FIG. 13A, in the illustrative embodiment according to one or more aspects of the disclosure.

Then, the operator further inserts the process cartridge 13 into the main body 12. In response to this, as depicted in FIG. 13B, the first apparatus electrode 191 moves upwardly frontward relative to the drum cartridge 1 so as to be situated behind the grid electrode 105 while sliding over the right surface of the right sidewall 65 of the cover frame 36.

Further, the second apparatus electrode 192 overrides the contact portion 145 of the second electrode 118 from the curved portion 147 and further moves upwardly frontward relative to the drum cartridge 1 so as to be situated on the right surface of the contact portion 145 of the second electrode 118 while sliding over the contact portion 145 of the second electrode 118.

The third apparatus electrode 193 moves upwardly frontward relative to the drum cartridge 1 so as to be situated at a lower rear end portion of the right sidewall 38 of the base frame 35 while sliding over the right surface of the right sidewall 38 of the base frame 35.

Meanwhile, the fourth apparatus electrode 194 is not in contact with the right sidewall 38 and is situated behind the drum cartridge 1.

The operator further inserts the process cartridge 13 into the main body 12. In response to this, as depicted in FIG. 14A, the first apparatus electrode 191 moves upwardly frontward relative to the drum cartridge 1 so as to be situated behind the charger electrode 104 while sliding over the right surface of the right sidewall 65 of the cover frame 36.

The second apparatus electrode 192 crosses the contact portion 145 of the second electrode 118 and further moves upwardly frontward relative to the drum cartridge 1 so as to be situated behind the grid electrode 105 while sliding over the right surface of the right sidewall 65 of the cover frame 36.

The third apparatus electrode 193 moves upwardly frontward relative to the drum cartridge 1 so as to be situated behind the curved portion 140 of the contact portion 138 of the first electrode 117 while sliding over the right surface of the right sidewall 38 of the base frame 35.

The fourth apparatus electrode 194 moves upwardly frontward relative to the drum cartridge 1 so as to be situated behind the curved portion 147 of the contact portion 145 of the second electrode 118 while sliding over the right surface of the right sidewall 38 of the base frame 35 and the right surface of the right sidewall 65 of the cover frame 36.

The operator further inserts the process cartridge 13 into the main body 12. In response to this, as depicted in FIG. 14B, the first apparatus electrode 191 moves upwardly frontward relative to the drum cartridge 1 while sliding over the right surface of the right sidewall 65 of the cover frame 36. When the process cartridge 13 reaches the particular position, the first apparatus electrode 191 comes into contact with the charger electrode 104 from the right.

The second apparatus electrode 192 moves upwardly frontward relative to the drum cartridge 1 while sliding over the right surface of the right sidewall 65 of the cover frame 36. When the process cartridge 13 reaches the particular position, the second apparatus electrode 192 comes into contact with the grid electrode 105 from the right.

The third apparatus electrode 193 overrides the contact portion 138 of first electrode 117 from the curved portion 140 and further moves upwardly frontward relative to the drum cartridge 1 while sliding over the contact portion 138 of first electrode 117. When the process cartridge 13 reaches the particular position, the third apparatus electrode 193 comes into contact with the contact portion 138 of the first electrode 117 from the right.

The fourth apparatus electrode 194 overrides the contact portion 145 of the second electrode 118 from the curved portion 147 and further moves upwardly frontward relative to the drum cartridge 1 while sliding over the contact portion 145 of the second electrode 118. When the process cartridge 13 reaches the particular position, the fourth apparatus electrode 194 comes into contact with the contact portion 145 of the second electrode 118 from the right.

Through the above-described procedure, the installation of the process cartridge 13 in the main body 12 is completed.

In order to remove the drum cartridge 1 from the main body 12, the installation procedure is performed in reverse.

More specifically, as depicted in FIG. 2, the operator opens the front cover 17 and pulls the process cartridge 13 to the upper front position with respect to the main body 12 via the opening 16. The operator then detaches the developing cartridge 20 from the process cartridge 13. Thus, the removal of the drum cartridge 1 from the main body 12 is completed.

6. Effects (1) According to the drum cartridge 1, as depicted in FIGS. 11A and 11B, driving force transmitted to the drum gear 96 from the drive source of the main body 12 is further transmitted to the first roller gear 156 via the first idle gear 154 and the Oldham coupling 155. With this configuration, a ratio of the peripheral speed of the first roller 6 relative to the photosensitive drum 2 may be widely changed.

According to the above-described embodiment, the Oldham coupling 155 is provided for transmitting driving force from the first idle gear 154 to the first roller gear 156. Therefore, even when the first roller 6 moves slightly relative to the photosensitive drum 2 due to their rotations, the Oldham coupling 155 may absorb the deviation of the rotating axes of the gears, whereby driving force transmitted from the outside of the drum cartridge 1 may be transmitted to the first roller 6 stably.

Accordingly, a ratio of the peripheral speed of the first roller 6 relative to the photosensitive drum 2 may be widely changed. Further, driving force may be transmitted from the photosensitive drum 2 to the first roller 6 stably without an occurrence of the deviation of the rotating axes among the gears. Thus, instability in rotation of the photosensitive drum 2 caused due to the deviation of the rotating axes among the gears may be restricted, whereby an image may be formed on a sheet P with stable quality.

Accordingly, cleaning may be performed on the surface of the photosensitive drum 2 using the first roller 6 with stably and certainty.

(2) According to the drum cartridge 1, as depicted in FIGS. 11A and 11B, the rotating speed of the first roller 6 relative to the photosensitive drum 2 may be reduced using the first idle gear 154, the second idle gear 164, and the second roller gear 168.

Thus, cleaning of the surface of the photosensitive drum 2 may be performed evenly using the first roller 6 as compared with a case where the rotating speed of the first roller 6 is increased relative to the rotating speed of the photosensitive drum 2.

(3) According to the drum cartridge 1, as depicted in FIG. 11A, the first roller gear 156 is disposed between the drum gear 96 and the Oldham coupling 155, whereby space may be used effectively.

Thus, the first roller gear 156, the drum gear 96, and the Oldham coupling 155 may be assembled effectively.

(4) According to the drum cartridge 1, as depicted in FIGS. 1 and 10, the provision of the second roller 7 may enhance the ability to remove and collect paper dust.

Further, the Oldham coupling 155 includes the second roller gear 168 for inputting driving force to the second roller 7, thereby restricting an increase of a parts count.

(5) According to the drum cartridge 1, as depicted in FIGS. 11A and 11B, the second idle gear 164 is further disposed in the driving force transmitting route from the drum gear 96 to the first roller gear 156, whereby a ratio of the peripheral speed of the first roller 6 relative to the photosensitive drum 2 may be surely widely changed.

(6) According to the drum cartridge 1, as depicted in FIG. 11A, as viewed in the right-left direction, the first idle gear 154 and the first roller gear 156 partially overlap each other, thereby restricting an increase in size of the drum cartridge 1.

(7) According to the drum cartridge 1, as depicted in FIGS. 10 and 11A, the gear holder 151 may improve the stability of the engagement between the first idle gear 154 and the second idle gear 164.

With this configuration, driving force may be surely transmitted from the first idle gear 154 to the second idle gear 164. Thus, the driving force may be further surely transmitted from the drum gear 96 to the first roller gear 156.

Further, the deviation of rotating axes among the gears may be restricted. Therefore, instability in rotation of the photosensitive drum 2 may be restricted and thus image formation may be implemented with stability.

(8) According to the drum cartridge 1, as depicted in FIG. 11A, the second idle gear 164 and the first idle gear 154, which have the respective diameters that are smaller than the diameter of the drum gear 96, may reduce the rotating speed of the first roller 6 relative to the photosensitive drum 2.

Thus, while a reduction in size of the drum cartridge 1 is achieved, the rotating speed of the first roller 6 relative to the photosensitive drum 2 may be reduced and cleaning may be performed on the surface of the photosensitive drum 2 with certainty.

(9) According to the drum cartridge 1, as depicted in FIGS. 1 and 11B, while the photosensitive drum 2 and the first roller 6 rotate in the same direction at their contacting point, a ratio of the peripheral speed of the first roller 6 relative to the photosensitive drum 2 may be widely changed and cleaning may be performed on the surface of the photosensitive drum 2 using the first roller 6 with certainty.

What is claimed is:

1. A drum cartridge comprising:

a photosensitive drum rotatable about an axis;

a first cleaning roller including a first shaft extending in a direction extending along the axis;

a second cleaning roller including a second shaft extending in the direction of the first shaft, the second cleaning roller including a surface contacting a surface of the first cleaning roller, the second cleaning roller spaced apart from the photosensitive drum;

a bearing through which the first shaft and the second shaft are inserted;

a first cleaning gear rotatable with the first cleaning roller;

a second cleaning gear rotatable with the second cleaning roller and engaging with the first cleaning gear;

a drum gear being rotatable with the photosensitive drum;

a first idle gear engaging with the drum gear;

a second idle gear engaging with the first idle gear; and a coupling joining the second cleaning gear and the second idle gear, the coupling being disposed between the second cleaning gear and the second idle gear in the direction of the first shaft and rotatable in unison with the second cleaning gear and the second idle gear.

2. The drum cartridge according to claim 1, wherein the first and second cleaning rollers are movable together between a first position and a second position.

3. The drum cartridge according to claim 2, wherein the coupling maintains engagement of the first cleaning gear to the second cleaning gear and engagement of the second idle gear to the first idle gear in the first position and the second position.

4. The drum cartridge according to claim 2, wherein the coupling is configured to slide with respect to at least one of the second cleaning gear and the second idle gear, in a case where the first and second cleaning rollers move between the first position and the second position.

5. The drum cartridge according to claim 2, wherein the first position comprises an engaged position in which the first cleaning roller contacts the photosensitive drum and the second position comprises a disengaged position in which the first cleaning roller is spaced apart from the photosensitive drum.

6. The drum cartridge according to claim 1, wherein the bearing maintains relative positions of the first and second shafts.

7. The drum cartridge according to claim 1, further comprising a pressing member configured to press the bearing toward the photosensitive drum.

8. The drum cartridge according to claim 1, wherein the first cleaning gear is disposed at an opposite side of the bearing from the first cleaning roller in the direction.

9. The drum cartridge according to claim 1, wherein the second cleaning gear is disposed at an opposite side of the bearing from the second cleaning roller in the direction of the first shaft.

10. The drum cartridge according to claim 1, wherein the first cleaning gear is rotatable around a first axis extending through the first shaft in the direction.

11. The drum cartridge according to claim 10, wherein the second cleaning gear is rotatable around a second axis extending through the second shaft in the direction of the first shaft.

12. The drum cartridge according to claim 1, wherein at least a portion of circumference of the first idle gear and at least a portion of a circumference of the first cleaning gear are aligned in the direction of the first shaft.

13. The drum cartridge according to claim 1, further comprising:

a gear holder having an outer surface and an inner surface, wherein the gear holder includes:

a first shaft extending from the inner surface in the direction of the first shaft; and a second shaft extending from the inner surface in the direction of the first shaft;

wherein the first idle gear is configured to rotate about the first shaft, wherein the second idle gear is configured to rotate about the second shaft.

14. The drum cartridge according to claim 2, further comprising:

a lever adjustable to move the first and second cleaning rollers between the first position and the second position, wherein the coupling is configured to slide with respect to at least one of the second cleaning gear and the second idle gear, in a case where the first and second cleaning rollers move between the first position and the second position.

15. The drum cartridge according to claim 1, wherein the coupling having a first surface and a second surface opposite to the first surface in the direction of the first shaft, wherein the first surface includes a first channel extending in a first radial direction perpendicular to the direction of the first shaft, wherein the second surface includes a second channel extending in a second radial direction perpendicular to the first radial direction and the direction of the first shaft, wherein the second cleaning gear includes:

a first projection engaging with the first channel; and wherein the second idle gear includes:

a second projection engaging with the second channel.

16. The drum cartridge according to claim 15, a lever adjustable to move the first and second cleaning rollers between the first position and the second position;

wherein the first channel slides along the first projection, and the second channel slides along the second projection, in a case where the first and second cleaning rollers move between the first position and the second position.

17. The drum cartridge according to claim 15, wherein the second idle gear has a plurality of gear teeth on a circumferential surface of the second idle gear, and wherein the second projection extends from a surface of the second idle gear facing the coupling, the surface being recessed with respect to an edge of the idle gear in the direction of the first shaft.

18. The drum cartridge according to claim 15, wherein the coupling is disposed between the second cleaning gear and the second idle gear in the direction of the first shaft;

wherein the first projection extends from the second cleaning gear toward the coupling.

19. The drum cartridge according to claim 1, wherein the first idle gear, the second idle gear and the second cleaning roller gear are sized to provide a relative gearing of the first cleaning gear and the drum gear such that a rotating speed of the first cleaning gear is different from a rotating speed of the drum gear.

20. The drum cartridge according to claim 5, wherein the pressing member is a spring configured to press the bearing toward the photosensitive drum.

* * * * *